US007976314B2

(12) United States Patent
Ohmori et al.

(10) Patent No.: US 7,976,314 B2
(45) Date of Patent: Jul. 12, 2011

(54) BUFFER, ADAPTER, AND CONNECTING DEVICE FOR ATTACHING THE SAME BUFFER OR ADAPTER

(75) Inventors: Yasuhiro Ohmori, Yao (JP); Masahiko Nakamura, Yao (JP)

(73) Assignee: Hosiden Corporation, Yao-Shi (JP)

( * ) Notice: Subject to any disclaimer, the term of this patent is extended or adjusted under 35 U.S.C. 154(b) by 118 days.

(21) Appl. No.: 12/204,060

(22) Filed: Sep. 4, 2008

(65) Prior Publication Data

US 2009/0098744 A1 Apr. 16, 2009

(30) Foreign Application Priority Data

Oct. 12, 2007 (JP) ..... 2007-266327
Feb. 1, 2008 (JP) ..... 2008-023204

(51) Int. Cl.
*H01R 41/00* (2006.01)

(52) U.S. Cl. ..... 439/33; 439/841

(58) Field of Classification Search ..... 439/33, 439/32, 788, 841
See application file for complete search history.

(56) References Cited

U.S. PATENT DOCUMENTS

| | | | | |
|---|---|---|---|---|
| 2,259,378 | A * | 10/1941 | Heidkamper | 439/244 |
| 3,820,207 | A * | 6/1974 | Shanks | 445/32 |
| 4,510,416 | A * | 4/1985 | Meade et al. | 313/579 |
| 4,928,210 | A | 5/1990 | Hayakawa et al. | |
| 6,086,432 | A * | 7/2000 | Frinker et al. | 439/841 |

FOREIGN PATENT DOCUMENTS

| | | |
|---|---|---|
| EP | 2 056 327 | 5/2009 |
| EP | 2073614 | 6/2009 |
| FR | 1013919 | 8/1952 |
| JP | 52-029922 | 3/1977 |
| JP | 57-082089 | 5/1982 |
| JP | 64-48851 U | 3/1989 |
| JP | 8-180842 | 7/1996 |
| JP | 2004-281133 | 10/2004 |
| JP | 2005-11710 | 1/2005 |
| JP | 2006-93011 | 4/2006 |
| JP | 2006-351529 A1 | 12/2006 |
| JP | 2007-234551 | 9/2007 |
| JP | 2007234551 A * | 9/2007 |
| KR | 2003-0067127 | 8/2003 |

(Continued)

OTHER PUBLICATIONS

Notification of Reasons for Refusal dated Nov. 10, 2009 for the counterpart Japanese application No. 2008-023204 with English translation.

(Continued)

*Primary Examiner* — T C Patel
*Assistant Examiner* — Travis Chambers
(74) *Attorney, Agent, or Firm* — Kratz, Quintos & Hanson, LLP

(57) ABSTRACT

An adapter of the present invention is used to connect between a lead terminal of an electronic component and a contact of a connecting device. The adapter includes a first connecting part, adapted for electrical and mechanical connection to the lead terminal; a second connecting part, disposed at a spaced relation to the first connecting part in a length direction of the electronic component and connectable to the contact electrically and mechanically; and an elastically deforming part, provided between the first and second connecting parts and elastically deformable in accordance with thermal expansion deformation or thermal contraction deformation in the length direction of the electronic component.

29 Claims, 22 Drawing Sheets

FOREIGN PATENT DOCUMENTS

WO WO 2009/022480 2/2009

OTHER PUBLICATIONS

Japanese Office Action dated May 18, 2010, along with English translation.

Partial European Search Report dated May 18, 2010.

Notification of Reasons for Refusal mailed on Feb. 9, 2009 for the counterpart Japanese application No. 2008-023204 with English translation.

European Search Report dated Oct. 5, 2010.

* cited by examiner

S

200

300

(a)

(b)

400

(a)

(b)

(c)

(a)

(b)

(c)

500

(a)

(b)

(a)

(b)

(c)

400

(a)

(b)

(a)

(b)

BUFFER, ADAPTER, AND CONNECTING DEVICE FOR ATTACHING THE SAME BUFFER OR ADAPTER

The present application claims priority under 35 U.S.C. §119 of Japanese Patent Application Nos. 2007-266327 and filed on Oct. 12, 2007 and Feb. 1, 2008, respectively, the disclosure of which is expressly incorporated by reference herein in its entity.

BACKGROUND OF THE INVENTION

1. Field of the Invention

The present invention relates to a buffer and an adapter to be attached to a lead terminal of an electronic component such as a cold cathode fluorescent lamp, and to be attached to a connecting device together with the electronic component, and the connecting device to attach thereto the buffer or the adapter.

2. Description of the Related Art

For the purpose of protecting a lead terminal of a cold cathode fluorescent lamp, there is known a conductive cap to cover the lead terminal and an end part of the lamp part of the cold cathode fluorescent lamp.

This cap has a cylindrical body for covering the end part of the lamp part of the cold cathode fluorescent lamp, and a connecting part electrically and mechanically connected to the lead terminal of the cold cathode fluorescent lamp by conductive adhesive or solder. The cylindrical body is sandwiched by a contact of a connecting device, so that the lead terminal of the cold cathode fluorescent lamp is electrically connected to the contact of the connecting device (refer to Japanese Utility Model Application Laid-Open Publication No. 64-48851 and Japanese Patent Application Laid-Open Publication No. 2006-351529).

More specifically, the contact does not directly sandwich the lead terminal of the cold cathode fluorescent lamp but sandwich the cylindrical body of the cap, so as not to apply sandwiching load to the lead terminal of the cold cathode fluorescent lamp and a base portion thereof.

Uses of cold cathode fluorescent lamps include backlights for a display of a car navigation system or other devices. That is, cold cathode fluorescent lamps may be used under a high-temperature environment such as in the scorching sun in summer. If a cold cathode fluorescent lamp is placed under such a high-temperature environment, the lamp may be thermally expanded and deformed.

If the cold cathode fluorescent lamp is thermally expanded and deformed with the cap covering its end part and with the cylindrical body of the cap sandwiched by the contact of the connecting device, the end of the lamp part and the lead terminal of the cold cathode fluorescent lamp are pressed against the insider of the cap, thereby applying load to the end of the lamp part and the lead terminal.

Additionally, when the cold cathode fluorescent lamp is pressed against the cap due to the thermal expansion deformation, the cap is moved in a length direction of the cold cathode fluorescent lamp. This causes the cylindrical body of the cap to slide in the contact and be abraded, which may make the contact between the cap and the contact unstable.

SUMMARY OF THE INVENTION

The present invention is devised in light of the above-described circumstances. An object of the invention is to provide a buffer and an adapter capable of absorbing thermal expansion deformation or thermal contraction deformation of an electronic component such as a cold cathode fluorescent lamp, and a connecting device for attaching the buffer or the adapter.

In order to solve the above-described problems, a buffer of the present invention is interposed between a lead terminal of an electronic component and a connecting device. The buffer includes a first attaching part, adapted for attachment to the lead terminal; a second attaching part, disposed at a spaced relation to the first attaching part in a length direction of the electronic component and attachable to the connecting device; and an elastically deforming part, provided between the first and second attaching parts and elastically deformable in accordance with thermal expansion deformation or thermal contraction deformation in the length direction of the electronic component.

In the above-described buffer, even if the electronic component is deformed due to thermal expansion or contraction in a state where the first attaching part is attached to the lead terminal and where the second attaching part is attached to the connecting device, the elastically deforming part is elastically deformed to absorb the thermal expansion deformation or the thermal contraction deformation. Such configuration can restrain the electronic component from being pressed against the buffer or from being ripped from the buffer due to the thermal expansion deformation or the thermal contraction deformation of the electronic component. Thus, it is possible to reduce the load applied to a body part of the electronic component and the lead terminal during the thermal expansion deformation or the thermal contraction deformation.

An adapter of the present invention is used to connect between a lead terminal of an electronic component and a contact of a connecting device. The adapter includes a first connecting part, adapted for electrical and mechanical connection to the lead terminal; a second connecting part, disposed at a spaced relation to the first connecting part in a length direction of the electronic component and connectable to the contact electrically and mechanically; and an elastically deforming part, provided between the first and second connecting parts and elastically deformable in accordance with thermal expansion deformation or thermal contraction deformation in the length direction of the electronic component.

In the above-described adapter, even if the electronic component is deformed due to thermal expansion or contraction in a state where electrical and mechanical connection is established between the first connecting part and the lead terminal and between the second connecting part and the contact, the elastically deforming part is elastically deformed to absorb the thermal expansion deformation or the thermal contraction deformation. Such configuration can restrain the electronic component from being pressed against the adapter or from being ripped from the adapter due to the thermal expansion deformation or the thermal contraction deformation of the electronic component. Thus, it is possible to reduce the load applied to a body part of the electronic component and the lead terminal during the thermal expansion deformation or the thermal contraction deformation.

In the case where the second connecting part is of a tubular shape to receive an end part of a main body of the electronic component, the second connecting part may be sandwiched between the contact of the connecting device and a body of the connecting device, or sandwiched by the contact of the connecting device. The second connecting part of a tubular shape can thus provide secure contact with the contact, further providing stable electrical connection between the second connecting part and the contact.

Moreover, the second connecting part can be constituted to be arranged so as to be opposed to an end part of a main body of the electronic component in a state where the first connecting part is connected to the lead terminal. The second connecting part may be sandwiched together with the body part between the contact of the connecting device and a body of the connecting device.

In this case, simply sandwiching the second connecting part between the contact and the body allows the second connecting part to be electrically and mechanically connected to the contact. This configuration significantly eases the connection of the second connecting part to the contact.

Alternatively, the second connecting part can be constituted as to be opposed to the end part of the body part of the electronic component in the state where the first connecting part is connected to the lead terminal. The second connecting part may be sandwiched together with the body part by the contact of the connecting device.

Also in this case, simply sandwiching the second connecting part by the contact allows the second connecting part to be electrically and mechanically connected to the contact. This configuration significantly eases the connection of the second connecting part to the contact.

The first connecting part may be of rod shape or of coil shape and be electrically and mechanically connected to the lead terminal. In this case, the elastically deforming part is preferably of coil shape continuing to an end of the first connecting part, and adapted to receive at least one of the end part of the body part and the lead terminal of the electronic component. The second connecting part may be of coil shape continuing to an end of the elastically deforming part.

Thus, since the adapter has the first connecting part of rod shape or of coil shape and the second connecting part and the elastically deforming part of coil shape, the adapter can be made utilizing a coil spring with ease and at low cost.

It is preferable that the second connecting part are more closely coiled than the elastically deforming part. The closely coiled second connecting part can be securely sandwiched between the body and the contact of the connecting device, or sandwiched by the contact.

The elastically deforming part may alternatively be a partially notched plate-like body. Also in this case, the elastically deforming part can be made with ease and at low cost, by press-molding or other processing.

The first connecting part may be provided with an receiving hole to receive the lead terminal. In this case, the lead terminal received in the receiving hole can be electrically and mechanically connected to the first connecting part by soldering, welding or other processing. Consequently, the above configuration leads to ease in connection of the lead terminal to the first connecting part.

In the case where the first connecting part is a plate-like body of a substantially L shape in cross-sectional view, bent at a substantially right angle to form a first plate and a second plate, the receiving hole is provided in a portion of the second plate on the first plate side, and the first plate is provided with a depression that communicates with the receiving hole, the depression being adapted to fit the lead terminal received in the receiving hole. In this case, the lead terminal received in the receiving hole and the depression can be electrically and mechanically connected to the first plate by soldering, welding or other processing. Consequently, the above configuration further eases the connection of the lead terminal to the first connecting part.

A first aspect of a connecting device of the present invention has a body, including a containing part adapted to contain the adapter, an end part of a body part of an electronic component, and a lead terminal of the electronic component; and a contact, including a clamping part to be contained in the containing part of the body. The clamping part is adapted to sandwich the second connecting part of the adapter between an inner wall surface of the containing part and itself.

In the first aspect of the connecting device, the adapter and the electronic component can be easily connected to the contact, simply by inserting the adapter into the containing part of the body to sandwich the adapter between the clamping part of the contact and the inner wall surface of the containing part in the state where the first connecting part of the adapter is electrically and mechanically connected to the lead terminal.

A second aspect of the connecting device of the present invention has a body, including a containing part adapted to contain the adapter, an end part of a body part of an electronic component, and a lead terminal of the electronic component; and a contact, including a clamping part to be contained in the containing part of the body, the clamping part being adapted to sandwich the second connecting part of the adapter.

In the second aspect of the connecting device, the adapter and the electronic component can be easily connected to the contact, simply by inserting the adapter into the containing part of the body to sandwich the adapter with the clamping part of the contact in a state where the first connecting part of the adapter is electrically and mechanically connected to the lead terminal.

It is preferable that the inner wall surface of the containing part is provided with a stopper for preventing the second connecting part from moving in the length direction of the electronic component in accordance with thermal expansion deformation or thermal contraction deformation of the electronic component. Since such a stopper restrains the second connecting part from moving in the length direction in accordance with the thermal expansion deformation or the thermal contraction deformation of the electronic component, the stopper provides stable contact between the second connecting part and the contact, resulting in stable electrical connection between them.

Moreover, in place of the inner wall surface of the containing part, an inner surface of the clamping part of the contact can be provided with the stopper. Since such a stopper also restrains the second connecting part from moving in the length direction in accordance with the thermal expansion deformation or the thermal contraction deformation of the electronic component, the stopper provides stable contact between the second connecting part and the contact, resulting in stable electrical connection between them.

The stopper may have an irregular surface that is abuttable against the second connecting part. This stopper can favorably restrain the movement of the second connecting part.

The contact may further have a holding part to hold the body part of the electronic component between a wall surface of the body and itself. Alternatively, the contact may further have a pair of holding parts to hold the body part of the electronic component. By holding the body part of the electronic component with the holding part or the holding parts in this manner, it is possible to suppress vibration and the like of the electronic component, and to restrain load due to the vibration from being applied to the entire electronic component, and to prevent some portion of the electronic component from colliding with the adapter due to the vibration.

In the case where the connecting device is of a circuit board mounted type, the circuit board may have an elongated locking hole, and the body may further have a substantially L-shaped locking claw that having a basal part and a distal part substantially perpendicular to this basal part. The locking hole is receivable in the locking hole. The locking hole may have a wide part having a width slightly larger than a thickness of the distal part of the locking claw and a narrow part having a width slightly larger than a thickness of the basal part of the locking claw. When the locking claw is inserted into the wide part and is moved to the narrow part, the distal part of the locking claw is locked in an edge part of the narrow part.

The above configuration eases attachment of the body of the connecting device onto the circuit board. The attachment is performed simply by inserting the locking claw into the wide part of the locking hole and moving the same to the narrow part so as to lock the locking claw in the narrow part.

The circuit board may further have a lock hole. In this case, the body may further have an arm, being oriented along a width of the locking claw, a distal part of the arm being swingable along a surface of the circuit board, and a locking projection, being provided in the distal part of the arm and receivable in the lock hole. The lock hole may have a mountain part, being provided in one side surface of the lock hole and inclined upward in a direction from the wide part to the narrow part, a foot area, being provided at the foot of the mountain part, and a valley area, being provided beyond the mountain part. Upon insertion of the locking claw into the wide part and insertion of the locking projection into the foot area, in accordance with said movement of the locking claw, the locking projection moves across the mountain part while swinging the distal part of the arm, and the locking projection falls to the valley area to be locked against the mountain part.

That is, the locking claw is locked in the narrow part and the locking projection is locked against the mountain part, simply by inserting the locking claw into the wide part and the locking projection into the foot area, and thereafter moving the locking claw to the narrow part and moving the locking projection across the mountain part. In this manner, locking the locking projection against the mountain part prevents the locking claw from moving to the wide part. This configuration eases attachment of the body of the connecting device onto the circuit board while positioning the body in position on the circuit board.

In the case where a contact pattern is provided on the circuit board, it is preferable that the contact further includes a contact part that is contactable with the contact pattern in a state where the locking claw is locked in the narrow part of the locking hole. In this case, simply by moving the connecting device along the locking hole formed in the circuit board, the contact part of the contact can be easily connected to the contact pattern of the circuit board.

DESCRIPTION OF THE PREFERRED EMBODIMENTS

Hereinafter, embodiments of the present invention are described.

Embodiment 1

Figure 1:
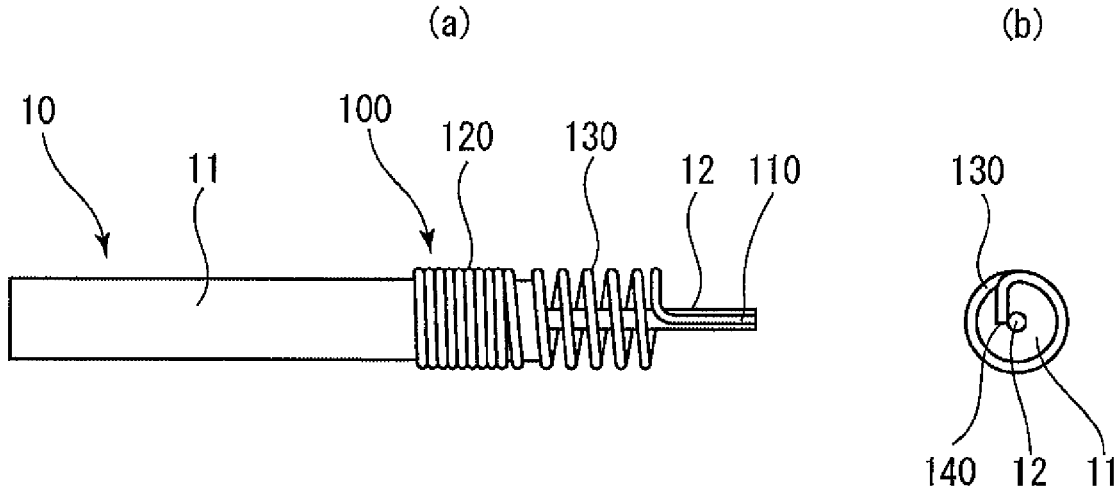
FIG. 1 illustrates a state where an adapter according to a first embodiment of the present invention is connected to a cold cathode fluorescent lamp, wherein FIG. 1(*a*) is a schematic plan view and FIG. 1(*b*) is a schematic right side view.
Figure 2:
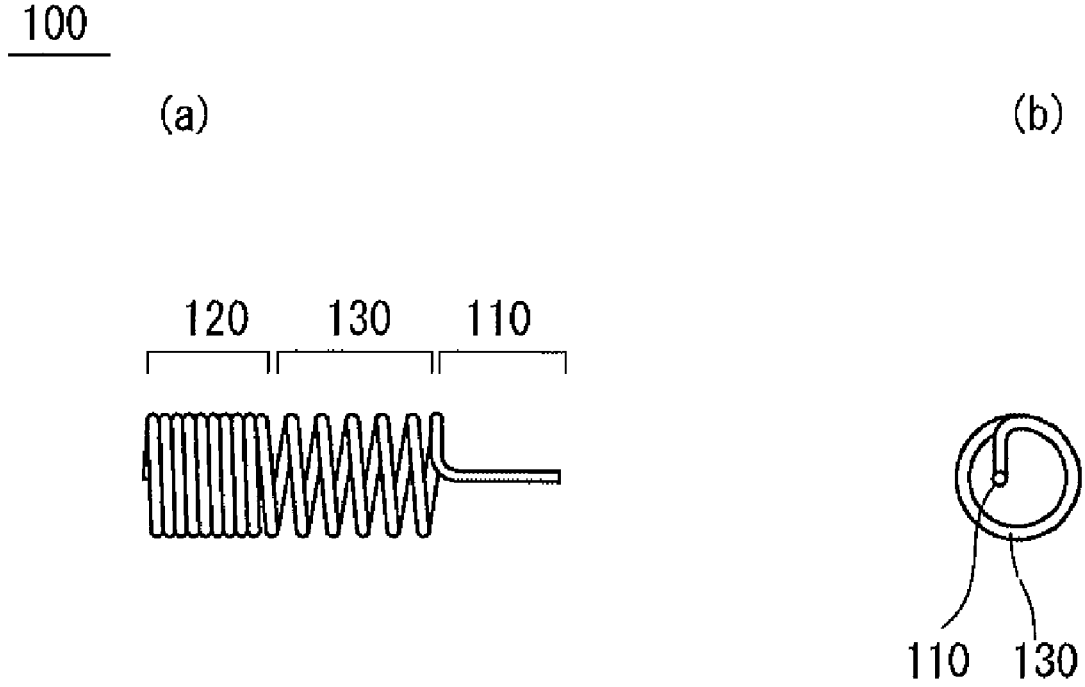
FIG. 2 illustrates the same adapter, wherein FIG. 2(*a*) is a schematic plan view, and FIG. 2(*b*) is a schematic right side view.
Figure 3:
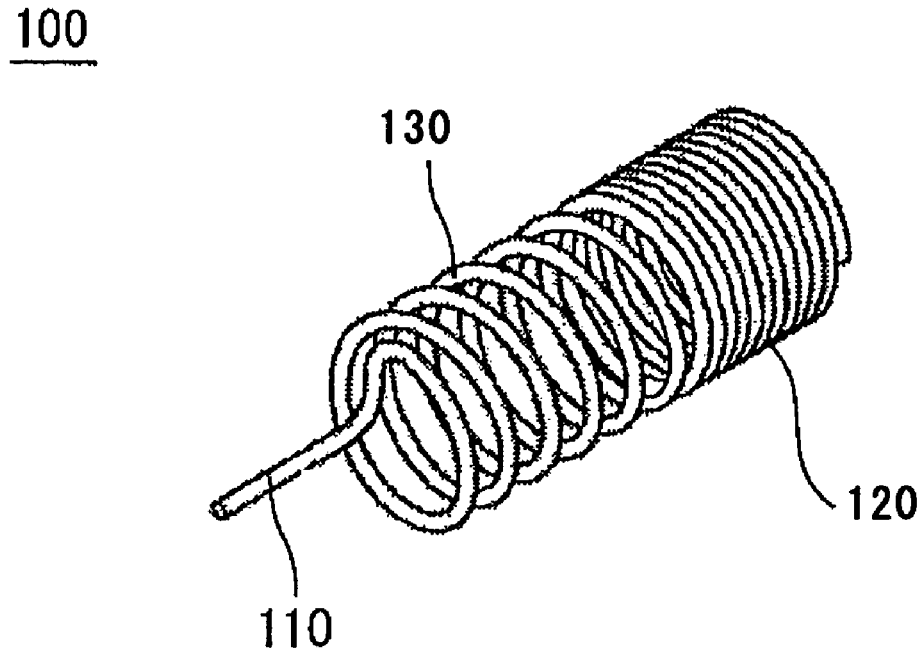
FIG. 3 is a schematic perspective view of the same adapter.

An adapter according to a first embodiment of the present invention is described referring to the drawings. FIG. 1 illustrates a state where the adapter according to the first embodiment of the present invention is connected to a cold cathode fluorescent lamp, wherein FIG. 1(*a*) is a schematic plan view and FIG. 1(*b*) is a schematic right side view. FIG. 2 illustrates the same adapter, wherein FIG. 2(*a*) is a schematic plan view, and FIG. 2(*b*) is a schematic right side view. FIG. 3 is a schematic perspective view of the same adapter.

The adapter 100 described here is a coil spring having conductivity. The adapter 100 includes a first connecting part 110 to be electrically and mechanically connected to a lead terminal 12 of a cold cathode fluorescent lamp 10 (electronic component), a second connecting part 120 spaced from the first connecting part 110 longitudinally of the cold cathode fluorescent lamp 10, and an elastically deforming part 130 being provided between the first and second connecting parts 110, 120 and elastically deformable in accordance with thermal expansion deformation or thermal contraction deformation longitudinally of the cold cathode fluorescent lamp 10. Hereinafter, a detailed description of each part is given.

The cold cathode fluorescent lamp 10, as illustrated in FIG. 1, has a lamp part 11 (body part), and a pair of lead terminals 12 provided at opposite lengthwise ends of the lamp part 11. FIG. 1 only illustrates one of the lengthwise ends of the cold cathode fluorescent lamp 10.

The second connecting part 120 is an end turn part of the coil spring as illustrated in FIGS. 1 to 3. An inner diameter of this second connecting part 120 is slightly larger than an outer diameter of the lamp part 11 of the cold cathode fluorescent lamp 10. This allows a basal portion of an end part of the lamp part 11 to be inserted into the second connecting part 120.

The elastically deforming part 130, as illustrated in FIGS. 1 to 3, is a coil spring part of the coil spring that continues to an end of the second connecting part 120, and whose coil intervals are larger than those of the second connecting part 120. This elastically deforming part 130 is set to have such a level of spring force as not to apply load to the cold cathode fluorescent lamp 10 during extension or contraction, particularly to the lead terminal 12 and a part of the lamp part 11 sealing the lead terminal 12. Moreover, an inner diameter of the elastically deforming part 130 is substantially the same as the inner diameter of the second connecting part 120. This allows a distal portion of the end part of the lamp part 11 and a base end of the lead terminal 12 to be inserted into the elastically deforming part 130.

The first connecting part 110 is a substantially L-shaped rod-like body as illustrated in FIGS. 1 to 3. The first connecting part 110 has a basal part that continues to an end of the elastically deforming part 130 and is bent toward a center of the coil spring, and a distal part that continues to the basal part and is bent at a right angle toward the one lengthwise end. This distal part of the first connecting part 110 is electrically and mechanically connected to a distal portion of the lead terminal 12 by soldering, welding or other means.

The adapter 100 configured as described above is connected to the cold cathode fluorescent lamp 10 in the following steps. First, the end part of the lamp part 11 and the lead terminal 12 of the cold cathode fluorescent lamp 10 are inserted into the second connecting part 120 and the elastically deforming part 130 to bring the distal portion of the lead terminal 12 into abutment against the distal part of the first connecting part 110. Consequently, the distal portion of the end part of the lamp part 11 and the base end portion of the lead terminal 12 are disposed inside the elastically deforming part 130, and the basal portion of the end part of the lamp part 11 is disposed inside the second connecting part 120.

Thereafter, the lead terminal 12 of the cold cathode fluorescent lamp 10 and the distal part of the first connecting part 110 are electrically and mechanically connected by soldering, welding or any other means. In the above steps, the adapter 100 is electrically and mechanically connected to the cold cathode fluorescent lamp 10.

Figure 4:
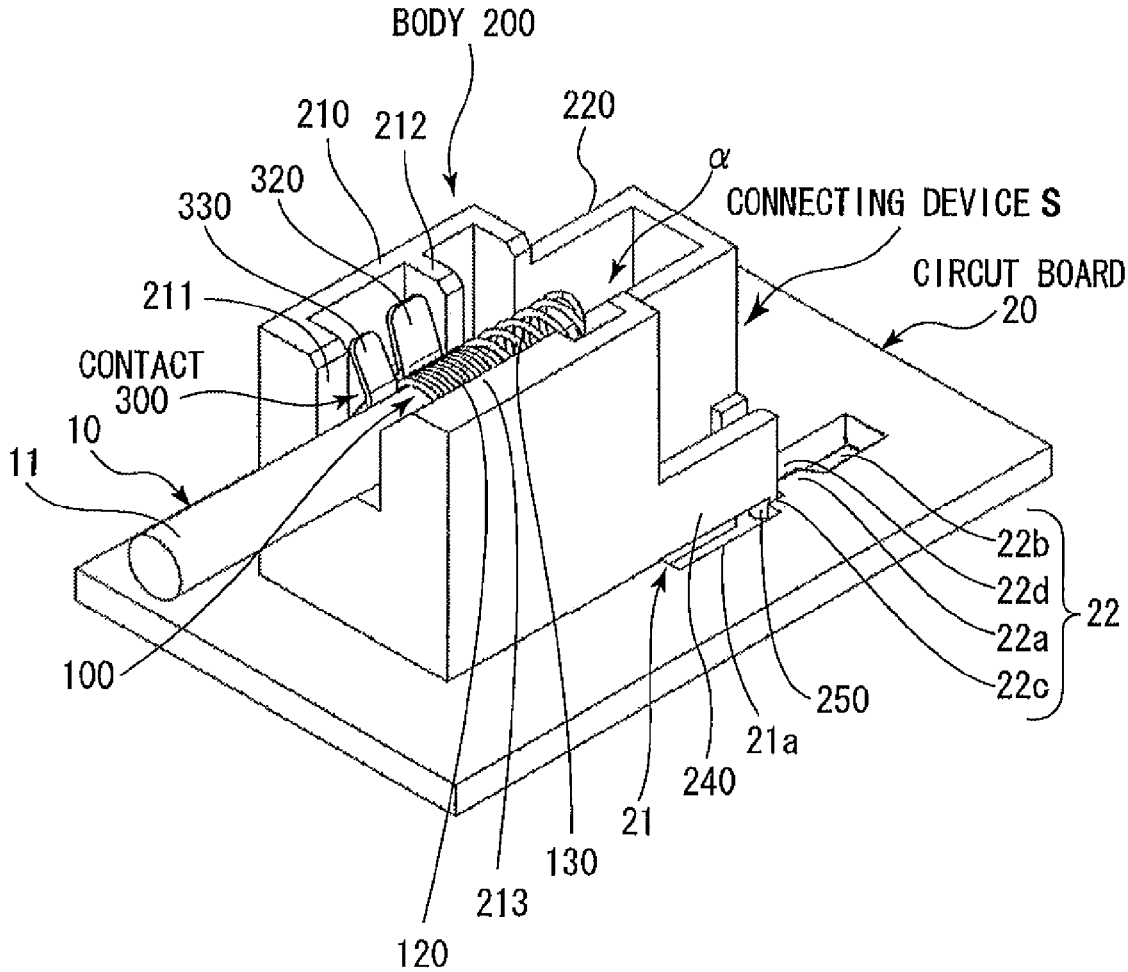
FIG. 4 is a schematic perspective view illustrating a connecting device according to the first embodiment of the present invention, in a state after the adapter has been connected and after the same device has been mounted on a circuit board.
Figure 5:
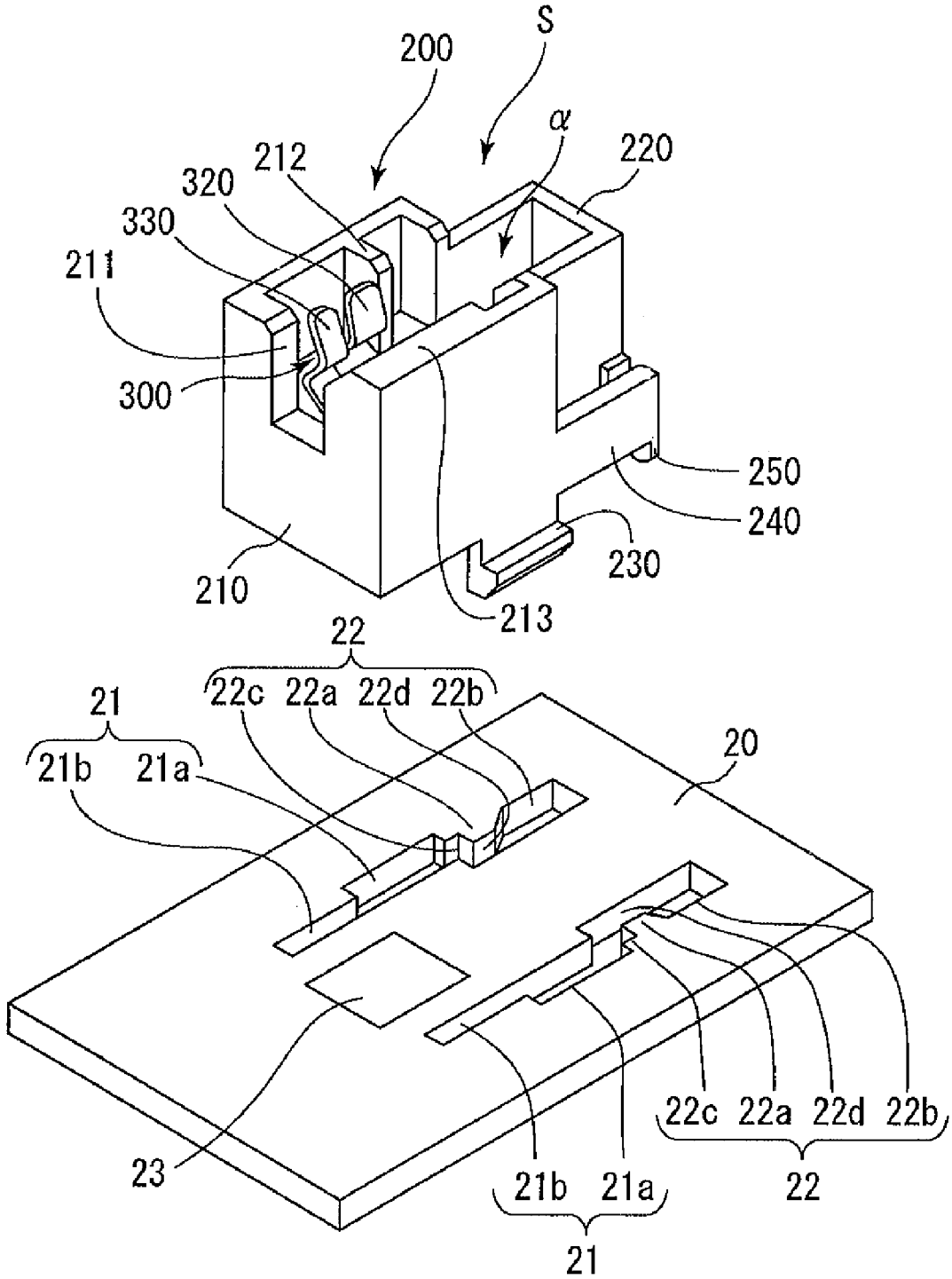
FIG. 5 is a schematic perspective view illustrating the same device, in a state before the adapter is connected and before the same device is mounted on the circuit board.
Figure 6:
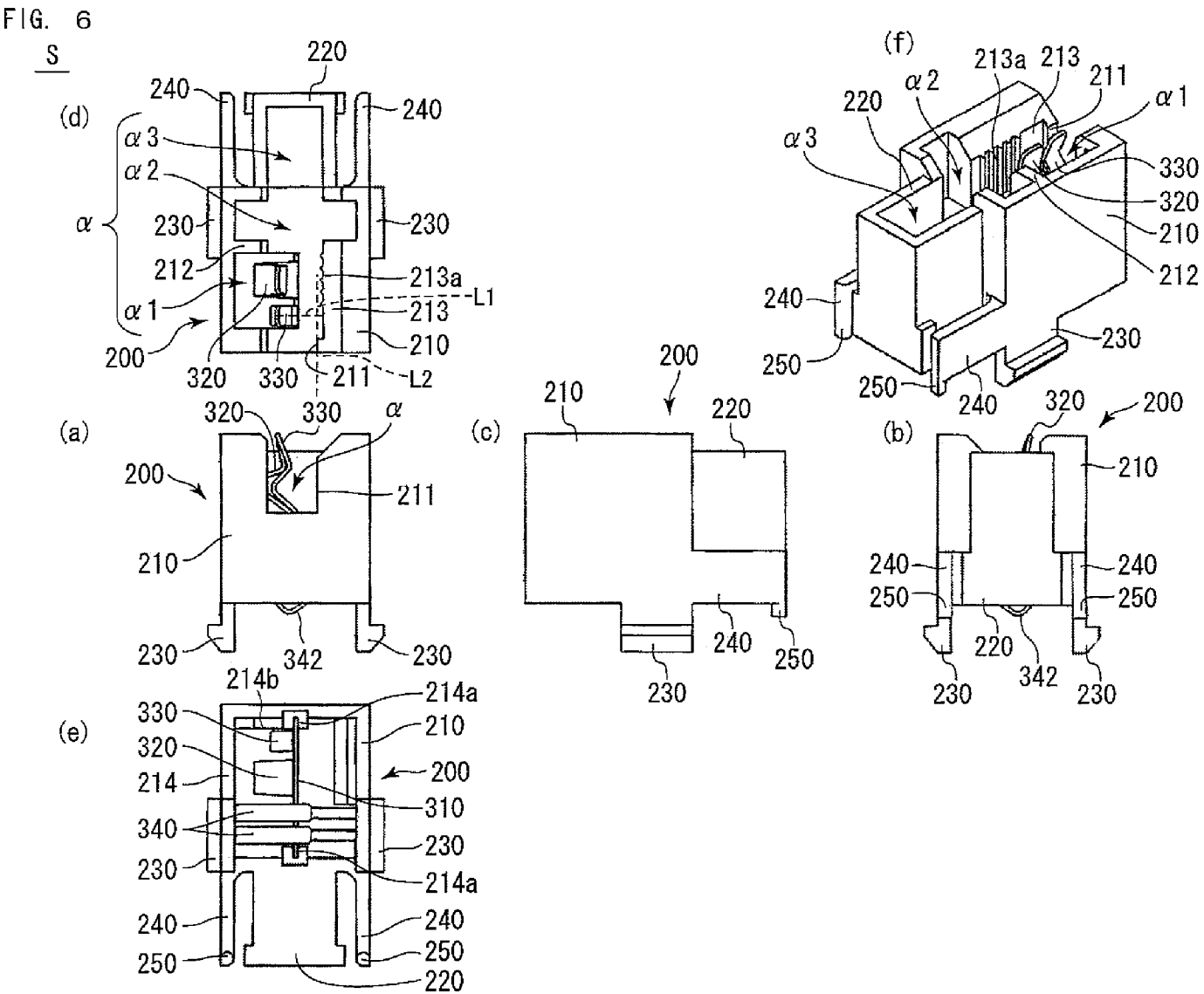
FIG. 6 illustrates the same device, wherein FIG. 6(*a*) is a schematic front view, FIG. 6(*b*) is a schematic back view, FIG. 6(*c*) is a schematic side view, FIG. 6(*d*) is a schematic plan view, FIG. 6(*e*) is a schematic bottom view, and FIG. 6(*f*) is a schematic perspective view seen from an upper back side.
Figure 7:
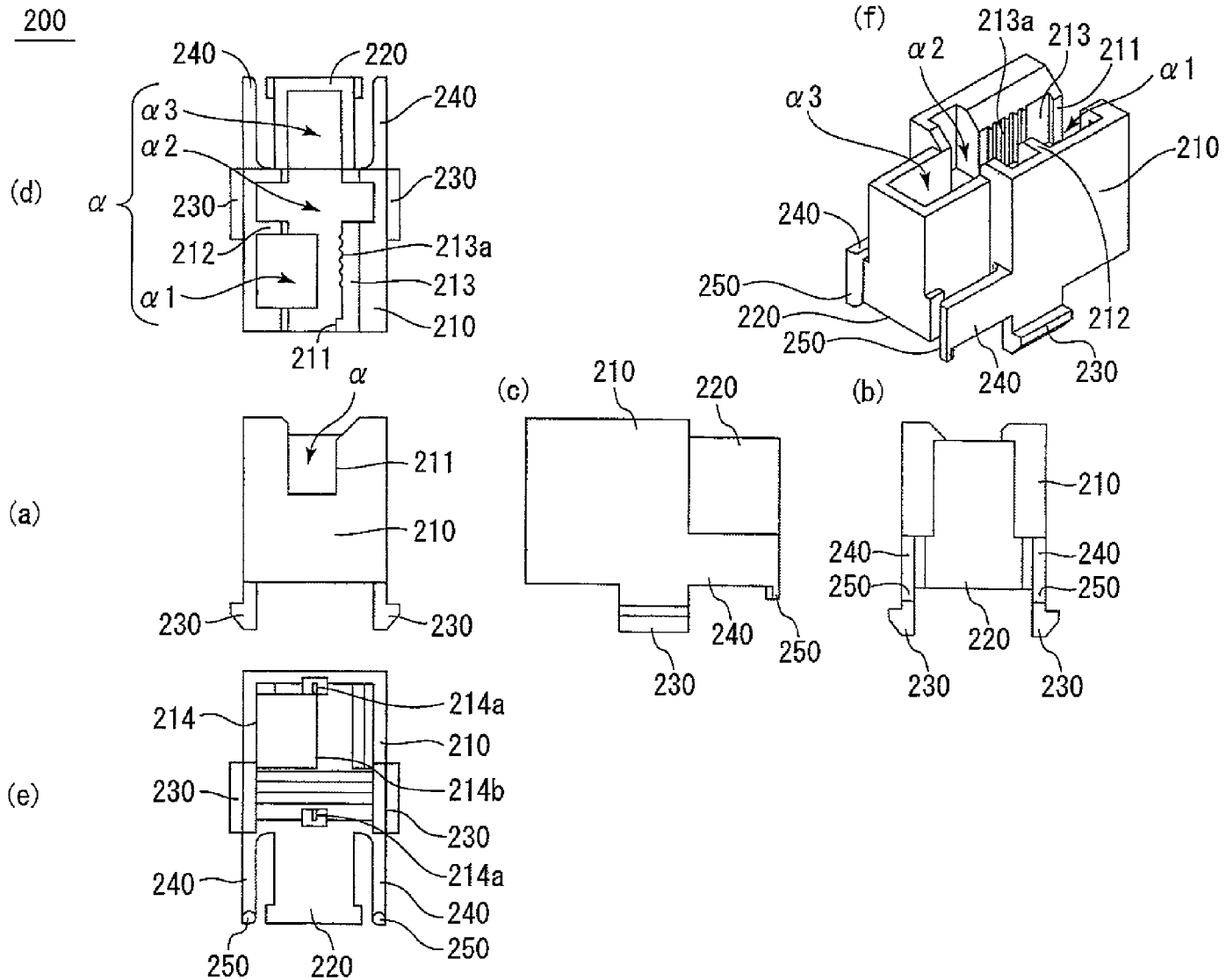
FIG. 7 illustrates a body of the same device, wherein FIG. 7(*a*) is a schematic front view, FIG. 7(*b*) is a schematic back view, FIG. 7(*c*) is a schematic side view, FIG. 7(*d*) is a schematic plan view, FIG. 7(*e*) is a schematic bottom view, and FIG. 7(*f*) is a schematic perspective view seen from an upper back side.
Figure 8:
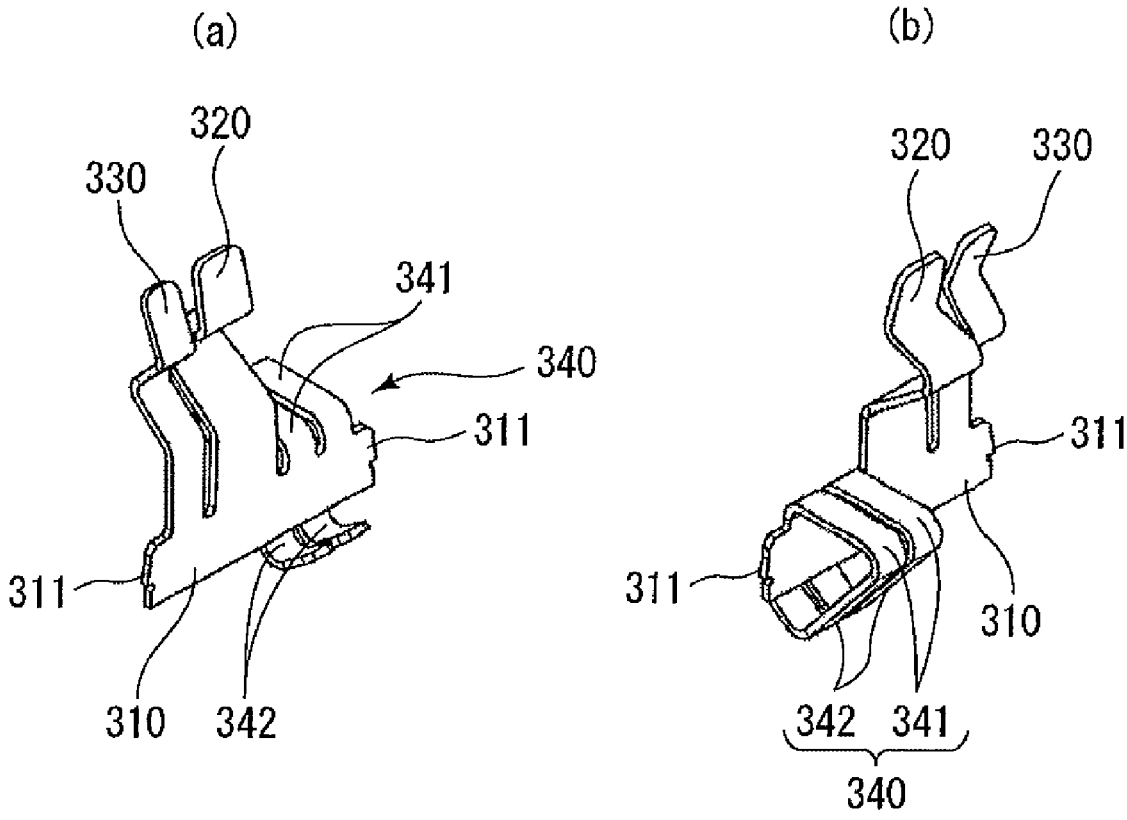
FIG. 8 illustrates a contact of the same device, wherein FIG. 8(*a*) is a schematic front view seen from an upper front side, and FIG. 8(*b*) is a schematic perspective view seen from an upper back side.
Figure 9:
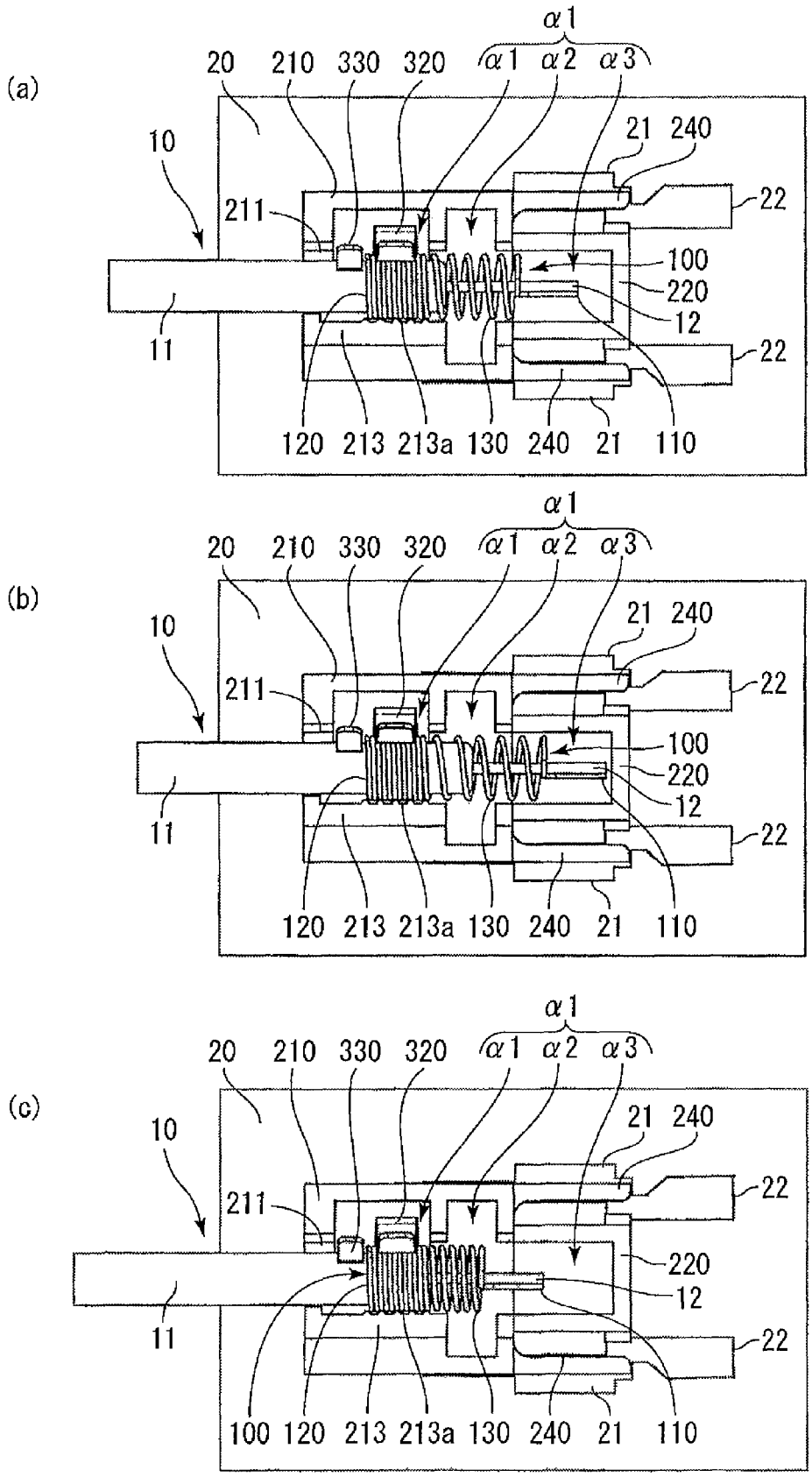
FIG. 9 is schematic plan views illustrating of the same device, in a state after the adapter has been connected and after the same device has been mounted on the circuit board, wherein FIG. 9(*a*) illustrates an initial state, FIG. 9(*b*) illustrates a state where the cold cathode fluorescent lamp is thermally expanded and the elastically deforming part is extended, and FIG. 9(*c*) illustrates a state where the cold cathode fluorescent lamp is thermally contracted and the elastically deforming part is contracted.
Figure 10:
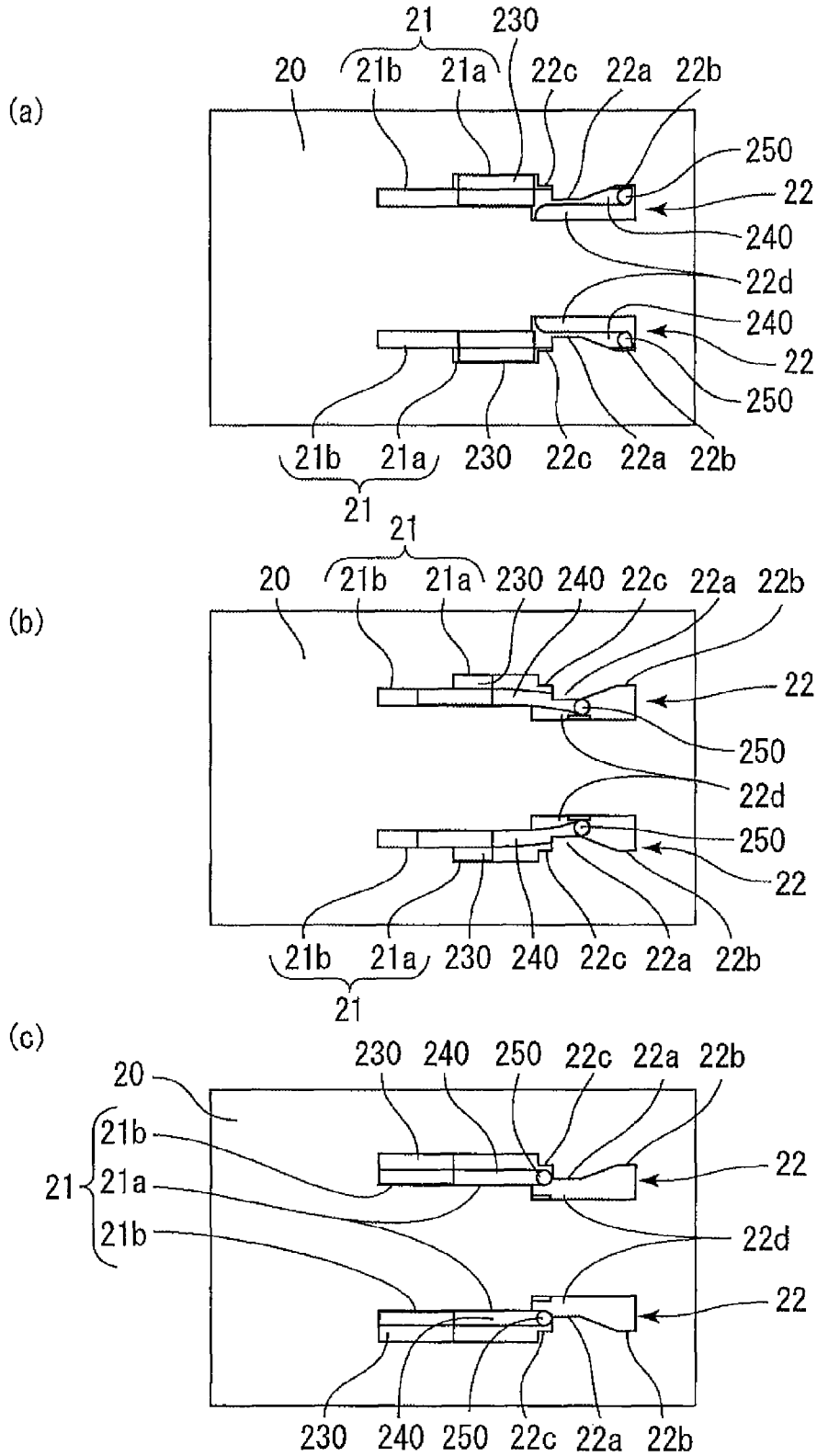
FIG. 10 is diagrammatic bottom views illustrating a board mounting process of the same device, wherein FIG. 10(*a*) illustrates a state where locking claws are inserted into lock holes, and locking projections are inserted into locking holes, FIG. 10(*b*) illustrates a slide moving state, and FIG. 10(*c*) illustrates a locked state.

Hereinafter, a connecting device to which the adapter 100 connected to the cold cathode fluorescent lamp 10 is connected is described referring to the drawings. FIG. 4 is a schematic perspective view illustrating the connecting device according to the first embodiment of the present invention, in a state after the adapter has been connected and after the same device has been mounted on a circuit board. FIG. 5 is a schematic perspective view illustrating the same device, in a state before the adapter is connected and before the same device is mounted on the circuit board. FIG. 6 illustrates the same device, wherein FIG. 6(*a*) is a schematic front view, FIG. 6(*b*) is a schematic back view, FIG. 6(*c*) is a schematic side view, FIG. 6(*d*) is a schematic plan view, FIG. 6(*e*) is a schematic bottom view, and FIG. 6(*f*) is a schematic perspective view seen from an upper back side. FIG. 7 illustrates a body of the same device, wherein FIG. 7(*a*) is a schematic front view, FIG. 7(*b*) is a schematic back view, FIG. 7(*c*) is a schematic side view, FIG. 7(*d*) is a schematic plan view, FIG. 7(*e*) is a schematic bottom view, and FIG. 7(*f*) is a schematic perspective view seen from an upper back side. FIG. 8 illustrates a contact of the same device, wherein FIG. 8(*a*) is a schematic front view seen from an upper front side, and FIG. 8(*b*) is a schematic perspective view seen from an upper back side. FIG. 9 is schematic plan views illustrating of the same device, in a state after the adapter has been connected and after the same device has been mounted on the circuit board, wherein FIG. 9(*a*) illustrates an initial state, FIG. 9(*b*) illustrates a state where the cold cathode fluorescent lamp is thermally expanded and the elastically deforming part is extended, and FIG. 9(*c*) illustrates a state where the cold cathode fluorescent lamp is thermally contracted and the elastically deforming part is contracted. FIG. 10 is diagrammatic bottom views illustrating a circuit board mounting process of the same device, wherein FIG. 10(*a*) illustrates a state where locking claws are inserted into locking holes and locking projections are inserted into lock holes, FIG. 10(*b*) illustrates a slide moving state, and FIG. 10(*c*) illustrates a locked state.

A connecting device S illustrated in FIGS. 4 to 6 is a socket to connect thereto the adapter 100 with the cold cathode fluorescent lamp 10 connected, and to be mounted on a circuit board 20. The connecting device S includes a body 200, and a contact 300 attached to the inside of the body 200. Hereinafter, a detail description is given.

The circuit board 20, as illustrated in FIG. 5, has a pair of elongated locking holes 21 penetrating in a thickness direction thereof, a pair of elongated lock holes 22 communicating with the locking holes 21 respectively and penetrating in the thickness direction of the circuit board 20, and a contact pattern 23 provided on a surface between the pair of locking holes 21.

The locking holes 21 are substantially L-shaped holes. The locking hole 21 each have a wide part 21*a*, which has a slightly larger width than a thickness of a distal part of an locking claw 230, and a narrow part 21*b*, which has a slightly larger width than a thickness of a basal part of the locking claw 230 of the body 200.

The wide parts 21*a* are rectangular holes through which the locking claws 230 can be inserted or detached. The narrow parts 21*b* are rectangular holes, outer edges of which are used to lock the distal parts of the locking claws 230 inserted through the wide parts 21*a*.

Each of the lock holes 22 has a mountain part 22*a*, provided on one widthwise side surface thereof and inclined upward in the direction from the wide part 21*a* to the narrow part 21*b*, a foot area 22*b* of the mountain part 22*a*, a valley area 22*c* provided beyond the mountain part 22*a*, and a top area 22*d* of the mountain part 22*a* provided between the foot area 22*b* and the valley area 22*c*.

The foot areas 22*b* are holes through which locking projection 250 of the body 200 can be inserted or detached. The valley areas 22*c* are rectangular holes into which the locking projections 250 are fitted, and which lead to the wide parts 21*a*. The top areas 22*d* are rectangular holes communicating the foot areas 22*b* and the valley areas 22*c*.

The mountain parts 22*a* serve as guiding projections to guide the locking projections 250 from the foot areas 22*b* to the valley areas 22*c*, and also serve as locking projections to lock the locking projections 250 located in the valley areas 22*c*. This mountain parts 22*a* press the locking projections 250 when the locking projections 250 are guided from the foot areas 22*b* to the valley areas 22*c*, thereby swinging distal parts of arm 240 of the body 200.

The body 200 is an injection molded article of plastics material as illustrated in FIGS. 4 to 7. The body 200 has a substantially rectangular parallelepiped first box body 210, a substantially rectangular parallelepiped second box body 220, which is provided continuously to a central part of one lengthwise end of the first box body 210 and has a smaller width than that of the first box body 210, the pair of the locking claws 230 extending downward from opposite widthwise ends of the first box body 210, the pair of arms 240 provided on opposite ends of the one lengthwise end of the first box body 210 and extending toward the one lengthwise end of the first box body 210 (i.e., the width direction of the locking claws 230), and the pair of the locking projections 250 provided downward at respective distal ends of the arms 240.

Insides of the first box body 210 and the second box body 220 communicate with each other. The insides of these first and second box bodies 210, 220 form a containing space α that can contain the end part of the lamp part 11, the lead terminal 12 of the cold cathode fluorescent lamp 10, and the adapter 100 connected to the lead terminal 12.

In a central part of the other lengthwise end part of the first box body 210, there is provided with an opening 211 that communicates with the containing space α. The opening 211 allow insertion and detachment of the base portion of the end part of the lamp part 11 of the cold cathode fluorescent lamp 10.

On a central part of an inner wall surface on one widthwise end side of the first box body 210, a partition wall 212 is provided toward the other end side as illustrated in FIGS. 6(*d*), 6(*f*), 7(*d*) and 7(*f*). This partition wall 212 partially partitions the inside of the first box body 210. That is, the containing space α is divided into a first area α1 and a second area α2, which are the inside of the first box body 210 partitioned by the partition wall 212, and a third area α3, which is the inside of the second box body 220. The first area α1 is adapted to accommodate a clamping part 320 and a holding part 330 of the contact 300, as described later.

As to the inner wall surface on the other widthwise end side of the first box body 210, a portion thereof facing the first area α1 is protruded toward the above-mentioned one end side. This protruded portion forms a sandwiching wall 213 to sandwich the second connecting part 120 of the adapter 100 between the clamping part 320 of the contact 300 and itself.

The sandwiching wall 213 has a plurality of convex veins extending vertically in a portion thereof opposed to the clamping part 320 of the contact 300. In other words, the opposed portion forms an irregular surface 213*a* (i.e., stopper) that restrains the second connecting part 120 of the adapter 100 from moving in the length direction.

Moreover, a lower end portion of the first box body 210 has a recess 214 as illustrated in FIGS. 6(*e*) and 7(*e*). Opposite lengthwise ends of the recess 214 have a pair of slits 214*a* to press-fit the respective ends of a base plate 310 of the contact 300. The recess 214 also has a rectangular hole 214*b* in a bottom thereof that communicates with the first area al of the containing space α.

More specifically, when the base plate 310 of the contact 300 is press-fitted into the pair of slits 214*a*, the clamping part 320 and the holding part 330 of the contact 300 pass through the hole 214*b* to be inserted into the first area α1. Note that the combination of the containing space α and the recess 214 corresponds to a containing part as recited in the claims.

The locking claws 230 are substantially L-shaped plate-like bodies, each having the basal part and the distal part. The basal part is arranged downward on an edge of the recess 214 of the first box body 210. The distal part is substantially perpendicular to the base end portion, and it outer corner is cut off obliquely. The locking claws 230 are inserted into the locking holes 21 of the circuit board 20.

Each of the arms 240 is a substantially rectangular plate-like body, having a clearance with respect to each side surface of the second box body 220, and extending in parallel to the side surface of the second box body 220. The distal parts of the arms 240 can swing in a width direction of the second box body 220.

The locking projections 250 are substantially columnar projections that can be inserted into the respective lock holes 22 of the circuit board 20.

The contact 300 is formed by press-molding a metal plate having conductivity. As illustrated in FIG. 8, the contact 300 has the substantially rectangular base plate 310, the plate-like clamping part 320 provided in a central part of an upper end of the base plate 310, the holding part 330 provided on one end side of the clamping part 320 in the upper end of the base plate 310, and a pair of contact parts 340 provided on the other end side of the clamping part 320 in the upper end of the base plate 310.

Opposite lengthwise ends of the base plate 310 are provided with a pair of projections 311. The length of the base plate 310 including this pair of projections 311 is slightly larger than a distance between inner back surfaces of the pair of slits 214*a* of the recess 214 of the body 200. This allows the base plate 310 to be press-fitted into the pair of slits 214*a* at their ends and to be contained and held in the recess 214.

The pair of contact parts 340 each have a plate-like horizontal part 341 bent at a substantially right angle from the base plate 310, and a substantially reverse V-shaped plate-like contact body 342 bent obliquely downward from the horizontal part 341. As illustrated in FIG. 6(*a*) and FIG. 6(*b*), the height of the contact body 342 is set such as to project downward from the recess 214 in a state where the base plate 310 is held in the recess 214. That is, the contact body 342 can elastically contact against the contact pattern 23 of the circuit board 20.

The clamping part 320 is a plate-like body whose intermediate part is bent into a substantially V shape, and whose distal part is inclined toward the folded direction. The clamping part 320 is inserted into and contained in the first area α1 of the containing space α through the hole 214*b* in the state where the base plate 310 is held in the recess 214. When the clamping part 320 is in this contained state, a distance between the intermediate part thereof and the irregular surface 213*a* of the sandwiching wall 213 inside the first area α1 is set to be smaller than an outer diameter of the second connecting part 120 of the adapter 100. In this configuration, the second connecting part 120 of the adapter 100 is sandwiched and held between the intermediate part of the clamping part 320 and the irregular surface 213*a* of the sandwiching wall 213.

The holding part 330 is a plate-like body whose intermediate part is bent into a substantially V shape, and whose distal part is inclined toward the folded direction. The holding part 330 is smaller in width than the clamp 320. The holding part 330 is inserted into and contained in the first area α1 of the containing space α through the hole 214*b* in the state where the base plate 310 is held in the recess 214. In this contained state, the holding part 330 is configured such that a first virtual line L1 extending from the intermediate part of the holding part 330 toward the sandwiching wall 213 until it intersects a second virtual line L2 extending from an edge surface of the opening 211 of the body 200 toward the length direction of the body 200 is smaller in length than the outer diameter of the lamp part 11 of the cold cathode fluorescent lamp 10. This configuration allows the lamp part 11 of the cold cathode fluorescent lamp 10 to be sandwiched and held between the intermediate part of the holding part 330 and the edge of the opening 211 of the body 200. In this manner, by sandwiching and holding the lamp part 11 of the cold cathode fluorescent lamp 10 between the intermediate part of the holding part 330 and the edge of the opening 211 of the body 200, vibration of the lamp part 11 and the like can be suppressed. Further, load by the vibration can be restrained from being applied to the entire cold cathode fluorescent lamp 10 (particularly, the lead terminal 12, and the part of the lamp part 11 sealing the lead terminal 12 of the cold cathode fluorescent lamp 10), and the lamp part 11 can be prevented from colliding with the adapter 100 due to the vibration.

Hereinafter, description is given of an assembling procedure of the connection device S having the above-described configuration, and of a procedure of its board mounting. First, the clamping part 320 and the holding part 330 of the contact 300 are positioned and inserted into the hole 214*b* of the recess 214 of the body 200. Then, the end parts of the base plate 310 of the contact 300 are press-fitted into the pair of slits 214*a* of the recess 214 of the body 200. The clamping part 320 and the holding part 330 are thus contained in the first area α1 of the containing space α, and at the same time, the base plate 310 and the pair of the contact parts 340 are contained in the recess 214.

Thereafter, as illustrated in FIG. 10(*a*), the pair of locking claws 230 of the body 200 is positioned and inserted into the wide parts 21*a* of the pair of the locking holes 21 in the circuit board 20 and the pair of the locking projections 250 is positioned and inserted into the foot areas 22*b* of the pair of the lock holes 22. At this time, the contact bodies 342 of the pair of contact parts 340 of the contact 300 come into elastic contact with the surface of the circuit board 20.

Thereafter, as illustrated in FIG. 10(*b*), the pair of locking claws 230 is moved from the wide parts 21*a* toward the narrow parts 21*b* of the pair of locking holes 21.

At the same time, the pair of locking projections 250 is moved from the foot areas 22*b* toward the mountain parts 22*a* of the pair of lock holes 22. Consequently, the pair of the locking projections 250 is pressed against and guided by the mountain parts 22*a* of the pair of lock hole 22. As a result, the distal parts of the pair of arms 240 swing along the surface of the circuit board 20.

Thereafter, as illustrated 10(*c*), when the pair of locking claws 230 reaches the narrow parts 21*b* of the pair of the locking holes 21, they are locked against outer edges of the narrow parts 21*b*.

At the same time, the pair of the locking projections 250 crosses the mountain parts 22*a* of the pair of lock holes 22, and passes the top areas 22*d*. Then, the pair of locking projections 250 is released from the pressing by the mountain parts 22*a*, so that the pair of arms 240 is returned from the swung state by their own elastic force. As a result, the pair of locking projections 250 falls to the valley areas 22*c* to be locked against the mountain parts 22*a*.

At this time, the contact parts 340 of the contact 300 slide on the circuit board 20 and come into elastic contact with the contact pattern 23.

The pair of locking projections 250 is thus locked against the mountain parts 22*a*, preventing the pair of locking claws 230 from moving from the narrow parts 21*b* to the wide parts 21*a* of the pair of locking holes 21. As a result, the body 200 is kept in an attached state to the circuit board 20.

As needed, the body 200 can be removed from the circuit board 20 in the following steps. First, pinch and press inward, with fingers, the pair of locking projections 250 that is projected from the pair of the locking holes 21 on the bottom side of the circuit board 20. This pressing action releases engagement between the pair of locking projections 250 and the pair of mountain parts 22*a*. In this state, the pair of the locking projections 250 is moved to the pair of foot areas 22*b* across the pair of mountain parts 22*a*. At the same time, the pair of locking claws 230 is moved from the narrow parts 21*b* to the wide parts 21*a* of the pair of locking holes 21. Then, the pair of locking projections 250 is pulled out upward from the foot areas 22*b* of the pair of the lock holes 22, and the pair of locking claws 230 is pulled out upward from the wide parts 21*a* of the pair of locking holes 21. In the above steps, the body 200 can be easily removed from the circuit board 20.

The following describes a procedure for connecting the adapter 100, which has been connected to the cold cathode fluorescent lamp 10 as described above, to the connecting device S, which has been mounted on the circuit board 20 as described above, and a procedure for removing the same.

First, the second connecting part 120 of the adapter 100 is positioned and set on the distal part of the clamping part 320 of the contact 300 inside of the containing space α of the body 200. Consequently, the end part of the lamp part 11 of the cold cathode fluorescent lamp 10 is set on a distal part of the holding part 330 of the contact 300.

Thereafter, the end part of the lamp part 11 of the cold cathode fluorescent lamp 10 and the adapter 100 are pushed into the containing space α of the body 200. Consequently, the distal part of the clamping part 320 of the contact 300 is pressed by the second connecting part 120 of the adapter 100, thereby being elastically deformed in a direction away from the sandwiching wall 213 inside of the containing space α.

At the same time, the distal part of the holding part 330 of the contact 300 is pressed by the end part of the lamp part 11 of the cold cathode fluorescent lamp 10, thereby being elastically deformed in the direction away from the sandwiching wall 213 inside the containing space α.

Thereafter, once the second connecting part 120 of the adapter 100 is fitted in the intermediate part of the clamping part 320, the clamping part 320 moves and restores by its own elastic force in a direction approaching the sandwiching wall 213 inside the containing space α. As a result, the second connecting part 120 is sandwiched between the intermediate part of the clamping part 320 and the irregular surface 213*a* of the sandwiching wall 213. By thus sandwiching the second connecting part 120 between the clamping part 320 and the irregular surface 213*a* of the sandwiching wall 213, the adapter 100 is electrically and mechanically connected to the contact 300.

At the same time, once the end part of the lamp part 11 of the cold cathode fluorescent lamp 10 is fitted in the intermediate part of the holding part 330, the holding part 330 moves and restores by its own elastic force in the direction approaching the sandwiching wall 213 inside the containing space α. As a result, the end part of the lamp part 11 is sandwiched between the intermediate part of the holding part 330 and the edge of the opening 211 of the body 200.

In the above state where the adapter 100 and the cold cathode fluorescent lamp 10 are electrically and mechanically connected to the connecting device S, if the cold cathode fluorescent lamp 10 is thermally expanded and deformed in the length direction as illustrated in FIG. 9(*b*), the elastically deforming part 130 of the adapter 100 extends, and the first connecting part 110 of the adapter 100 moves to the right in the figure in the length direction, together with the lead terminal 12 of the cold cathode fluorescent lamp 10.

On the other hand, as illustrated in FIG. 9(*c*), when the cold cathode fluorescent lamp 10 is thermally contracted and deformed in the length direction thereof, the elastically deforming part 130 of the adapter 100 is contracted, and the first connecting part 110 of the adapter 100 moves to the left side in the figure in the length direction, together with the lead terminal 12 of the cold cathode fluorescent lamp 10.

At this time, the irregular surface 213*a* of the sandwiching wall 213 locks the second connecting part 120 of the adapter 100, and restrains the second connecting part 120 from moving in the length direction in accordance with the thermal expansion deformation or the thermal contraction deformation of the lamp part 11 of the cold cathode fluorescent lamp 10.

If a need arises to remove the adapter 100 and the cold cathode fluorescent lamp 10 from the connecting device S, the adapter 100 and the cold cathode fluorescent lamp 10 should be lifted upward. Consequently, an upper part of the intermediate part of the clamping part 320 of the contact 300 is pressed by the second connecting part 120 of the adapter 100, and is elastically deformed in the direction away from the sandwiching wall 213 inside of the containing space α. At the same time, an upper end part of the intermediate part of the holding part 330 of the contact 300 is pressed by the end part of the lamp part 11 of the cold cathode fluorescent lamp 10, and is elastically deformed in the direction away from the sandwiching wall 213 inside of the containing space α.

Thereafter, once the second connecting part 120 of the adapter 100 moves beyond the upper end part of the intermediate part of the clamping part 320, and once the end part of the lamp part 11 of the cold cathode fluorescent lamp 10 moves beyond the upper end part of the intermediate part of the holding part 330, the adapter 100 and the cold cathode fluorescent lamp 10 can be taken upward out of the connecting device S.

In the above described case where the adapter 100 is used to connect the cold cathode fluorescent lamp 10 to the connecting device S electrically and mechanically, there are the following advantages. Particularly, even if the cold cathode fluorescent lamp 10 is deformed due to thermal expansion or contraction in the state where the first connecting part 110 is mechanically connected to the lead terminal 12 of the cold cathode fluorescent lamp 10, and where the second connecting part 120 is sandwiched between the clamping part 320 of the contact 300 and the sandwiching wall 213 of the body 200 in the connecting device S, the elastically deforming part 130 of the adapter 100 is extended or contracted in accordance with the thermal expansion deformation or the thermal contraction deformation so as to absorb such deformation. Such configuration, unlike the conventional example, can prevent the end portion of the lamp part 11 and the lead terminal 12 of the cold cathode fluorescent lamp 10 from being pressed against or ripped from the adapter 100 attached to the connecting device S due to the thermal expansion deformation or the thermal contraction deformation. Consequently, it is possible to reduce the load applied to the cold cathode fluorescent lamp 10 during the thermal expansion deformation or the thermal contraction deformation.

Embodiment 2

Figure 11:
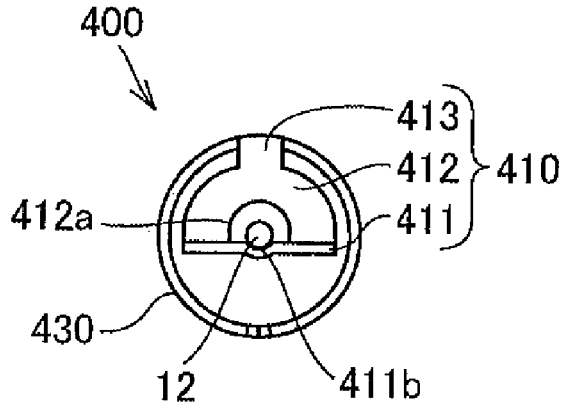
FIG. 11 illustrates a state where an adapter according to a second embodiment of the present invention is connected to a cold cathode fluorescent lamp, wherein FIG. 11(*a*) is a schematic front view and FIG. 11(*b*) is a schematic left side view.
Figure 11:
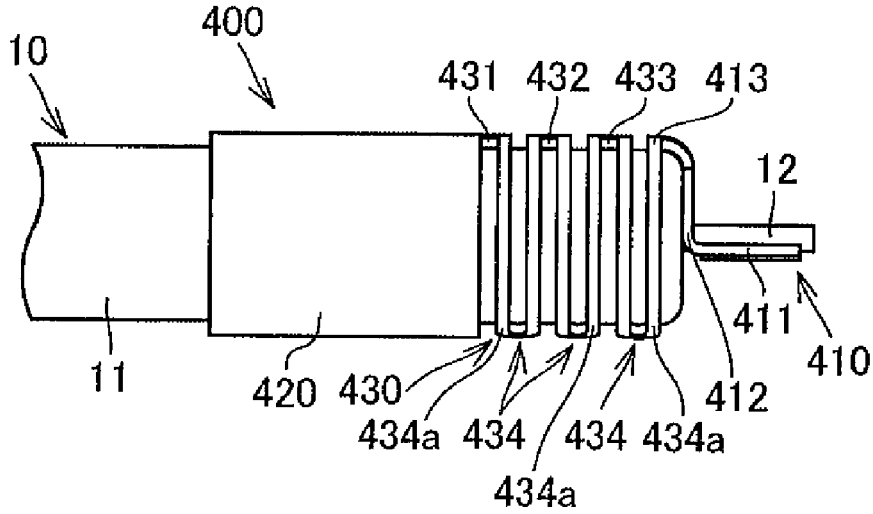
Figure 12:
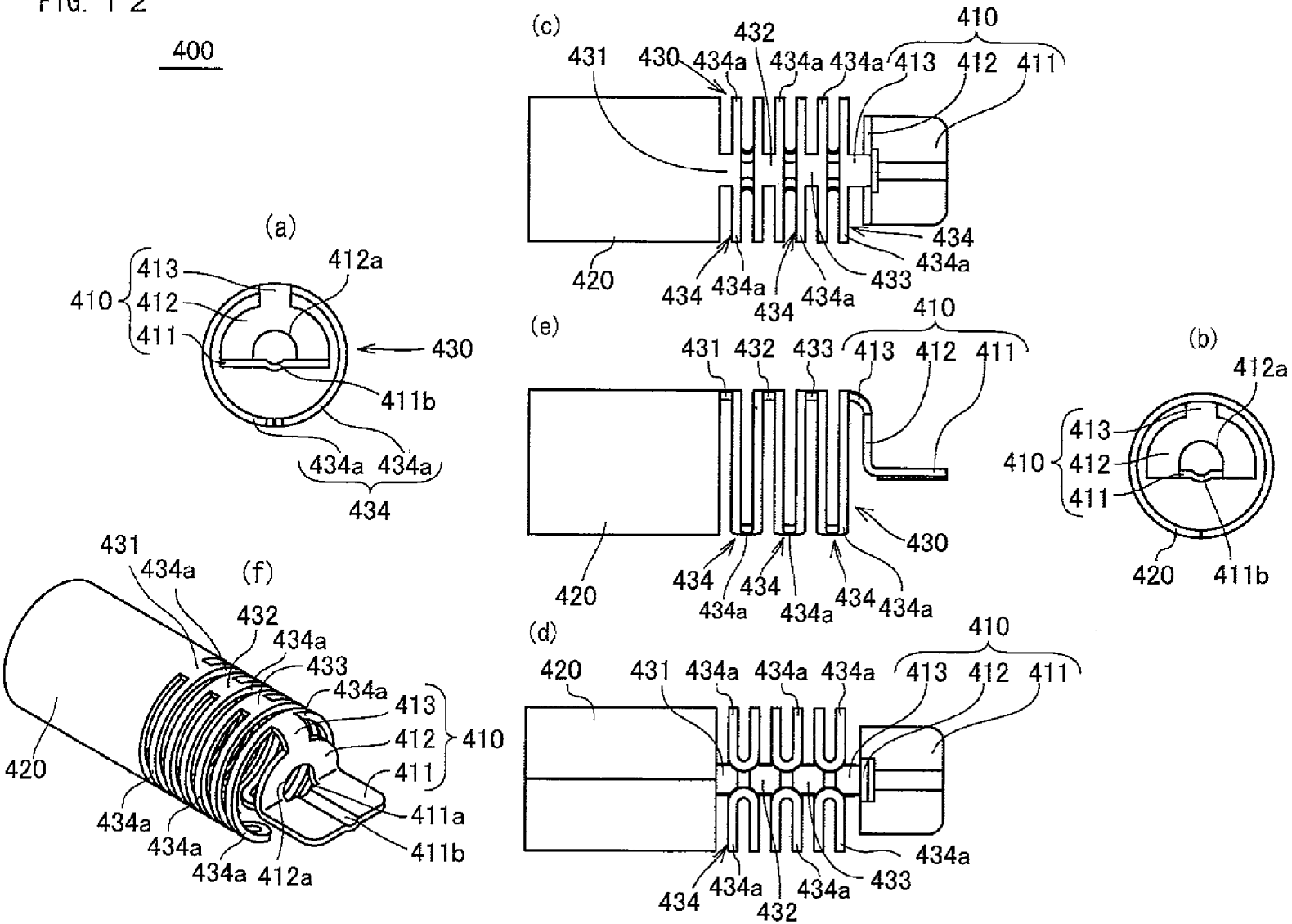
FIG. 12 illustrates the same adapter, wherein FIG. 12(*a*) is a front view, FIG. 12(*b*) is a back view, FIG. 12(*c*) is a plan view, FIG. 12(*d*) is a bottom view, FIG. 12(*e*) is a left side view, and FIG. 12(*f*) is a perspective view.
Figure 13:
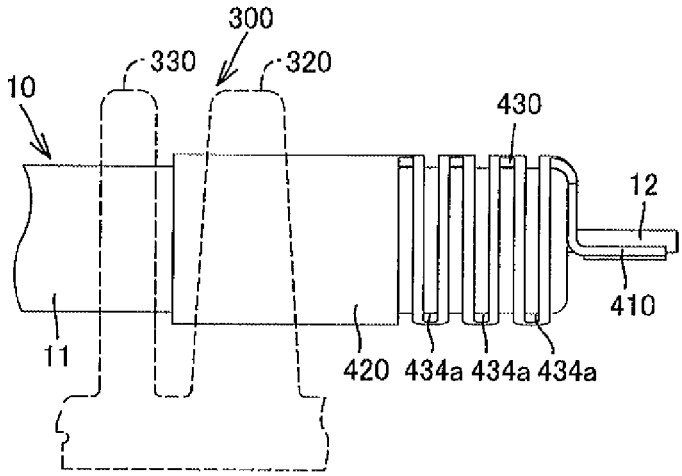
FIG. 13 is diagrammatic side views illustrating a state where the same adapter is sandwiched by a contact, wherein FIG. 13(*a*) illustrates a state before thermal expansion or thermal contraction of the cold cathode fluorescent lamp, FIG. 13(*b*) illustrates a state where the cold cathode fluorescent lamp is thermally expanded and an elastically deforming part is extended, and FIG. 13(*c*) illustrates a state where the cold cathode fluorescent lamp is thermally contracted and the elastically deforming part is contracted.
Figure 13:
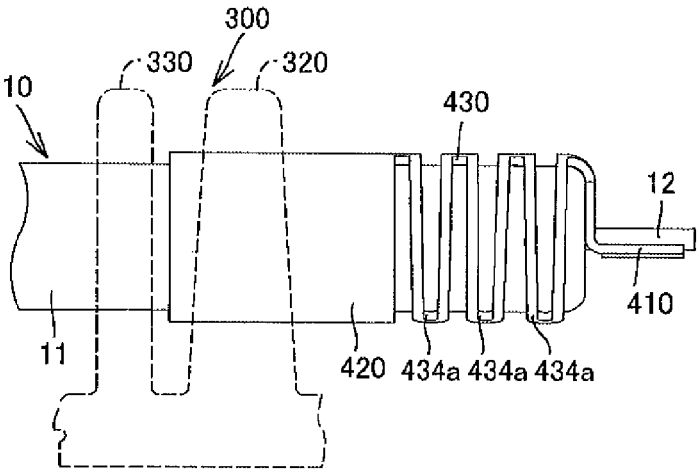
Figure 13:
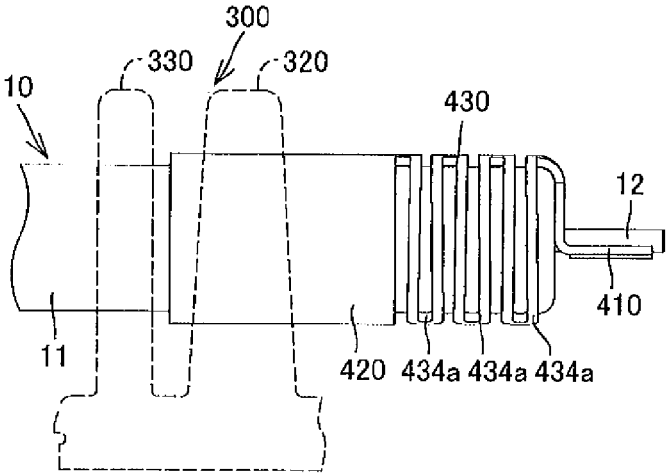

Hereinafter, an adapter according to a second embodiment of the present invention is described referring to the drawings. FIG. 11 illustrates a state where the adapter according to the second embodiment of the present invention is connected to a cold cathode fluorescent lamp, wherein FIG. 11(*a*) is a schematic front view and FIG. 11(*b*) is a schematic left side view; FIG. 12 illustrates the same adapter, wherein FIG. 12(*a*) is a front view, FIG. 12(*b*) is a back view, FIG. 12(*c*) is a plan view, FIG. 12(*d*) is a bottom view, FIG. 12(*e*) is a left side view, and FIG. 12(*f*) is a perspective view; and FIG. 13 is diagrammatic side views illustrating a state where the same adapter is sandwiched by a contact, wherein FIG. 13(*a*) illustrates a state before thermal expansion or thermal contraction of the cold cathode fluorescent lamp, FIG. 13(*b*) illustrates a state where the cold cathode fluorescent lamp is thermally expanded and an elastically deforming part is extended, and FIG. 13(*c*) illustrates a state where the cold cathode fluorescent lamp is thermally contracted and the elastically deforming part is contracted.

The adapter 400 described here is a press-molded article made by press-molding a metal plate having conductivity. The adapter 400 includes a first connecting part 410 to be electrically and mechanically connected to the lead terminal 12 of the cold cathode fluorescent lamp 10, a second connecting part 420 spaced from the first connecting part 410 in the length direction of the cold cathode fluorescent lamp 10, and an elastically deforming part 430 being provided between the first and second connecting parts 410, 420, and elastically deformable in accordance with thermal expansion deformation or thermal contraction deformation in the length direction of the cold cathode fluorescent lamp 10. Hereinafter, a detailed description of each part is given. Here, FIGS. 11 and 13 only illustrate one end portion of the cold cathode fluorescent lamp 10.

The first connecting part 410 is a plate body having a substantially L shape in cross-sectional view, as illustrated in FIGS. 11 and 12. The first connecting part 410 consists of a substantially rectangular first plate 411, a substantially semicircular second plate 412, which is arranged substantially at a right angle with respect to this first plate 411, and a third plate 413 of a substantially ¼ circular arc shape in cross-sectional view, which continues a top of the second plate 412.

A lower end portion (i.e., portion on the first plate side) of the second plate 412 is provided with a substantially semicircular receiving hole 412*a* to receive the lead terminal 12.

In the center of a rear end portion (portion on the second plate side) of the first plate 411, there is formed a substantially rectangular hole 411*a* continuing to the receiving hole 412*a*. Moreover, in the center of a distal portion of the first plate 411, a depression 411*b* extends over an entire length thereof. The depression 411*b*, a substantially semicircular arc recess having a corresponding outer diameter to the lead terminal 12, communicates with the hole 411*a*. More specifically, the depression 411*b* communicates with the receiving hole 412*a* through the hole 411*a*, so that the lead terminal 12 inserted into the receiving hole 412*a* is fitted in the depression 411*b*.

The second connecting part 420 is a plate body curved into a tubular shape so that its widthwise opposite end surfaces are opposed to each other. Its inner diameter is slightly larger than the outer diameter of the lamp part 11 of the cold cathode fluorescent lamp 10. That is, the end part of the lamp part 11 can be inserted into the second connecting part 420.

The elastically deforming part 430 is made by partially notching a tubular plate body having the same inner diameter as that of the second connecting part 420. The elastically deforming part 430 consists of a base plate 431, first and second coupling plates 432, 433, and three deforming parts 434. The base plate 431 continues to a distal end of a top portion of the second connecting part 420. The first and second coupling plates 432, 433 are arranged in spaced relation between the base plate 431 and the third plate 413 of the first connecting part 410. The three deforming parts 434 is disposed between the base plate 431 and the first coupling plate 432, between the first coupling plate 432 and the second coupling plate 433, and between the second coupling plate 433 and the third plate 413, respectively. The plate body is notched at portions, leaving the base plate 431, the first and second coupling plates 432, 433, and the three deforming parts 434.

The base plate 431, and the first and second coupling plates 432, 433 are substantially rectangular plate bodies.

One of the deforming parts 434 has a pair of curved parts 434*a*, each having a substantially U shape in side view and each being provided between either end of a distal portion of the base plate 431 and either end of a rear portion of the first coupling plate 432. Each of the curved parts 434*a* has end parts continuing to either end of the distal portion of the base plate 431 and either end of the rear portion of the first coupling plate 432, respectively, and a circular arc top part connecting these end parts. The curved parts 434*a* are curved into substantially semicircular arcs so that the top parts thereof are opposed to each other. Further the curved parts 434*a* are elastically deformable in a direction where the end parts are away from each other, or in a direction where they approaches each other (i.e., the curved parts 434*a* can be extended and contracted).

The other two deforming parts 434 are the same as the above-described one deforming part 434, except that the curved parts 434*a* are provided between the ends of a distal portion of the first coupling plate 432 and the ends of a rear portion of the second coupling plate 433, and between the ends of a distal portion of the second coupling plate 433 and the ends of an upper end portion of the third plate 413, respectively. The three deforming parts 434 are set to have such spring forces not to place an unduly heavy load during extension or contraction on the lead terminal 12 and the sealing part of the lamp part 11 for the lead terminal 12 of the cold cathode fluorescent lamp 10.

The adapter 400 having the above-described constitution is connected to the cold cathode fluorescent lamp 10 in the following manner. First, the end part of the lamp part 11 and the lead terminal 12 of the cold cathode fluorescent lamp 10 are inserted into the second connecting part 420 and the elastically deforming part 430. Then, the lead terminal 12 is inserted into the receiving hole 412*a* of the first connecting part 410 to be fitted in the depression 411*b*.

In this state, the lead terminal 12 of the cold cathode fluorescent lamp 10 and the first plate 411 of the first connecting part 410 are electrically and mechanically connected by soldering, welding or any other means.

After connecting the adapter 400 to the cold cathode fluorescent lamp 10 in the above manner, the adapter 400 is inserted into the containing space α of the connecting device S of Embodiment 1, so that the second connecting part 420 is sandwiched between the intermediate part of the clamping part 320 of the contact 300 and the sandwiching wall 213 of the body 200 of the connecting device S. In this state, as illustrated in FIG. 13(*b*), when the cold cathode fluorescent lamp 10 is thermally expanded and deformed in its length direction, the respective curved parts 434*a* of the elastically deforming part 430 of the adapter 400 are elastically deformed such that the end parts thereof are moved in directions away from each other (i.e., the elastically deforming part 430 is extended), so that the first connecting part 410 of the adapter 400 moves in the length direction, or to the right in the figure, together with the lead terminal 12 of the cold cathode fluorescent lamp 10.

On the other hand, as illustrate in FIG. 13(*c*), when the cold cathode fluorescent lamp 10 is thermally contracted and deformed in its length direction, the respective curved parts 434*a* of the elastically deforming part 430 of the adapter 400 are elastically deformed such that the end parts thereof are moved in directions approaching each other (i.e., the elastically deforming part 430 is contracted), so that the first connecting part 410 of the adapter 400 moves in the length direction, or to the left in the figure, together with the lead terminal 12 of the cold cathode fluorescent lamp 10.

In the above described case where the adapter 400 is used to connect the cold cathode fluorescent lamp 10 to the connecting device S electrically and mechanically, there are the following advantages. Particularly, even if the cold cathode fluorescent lamp 10 is deformed due to thermal expansion or contraction in the state where the first connecting part 410 is mechanically connected to the lead terminal 12 of the cold cathode fluorescent lamp 10, and where the second connecting part 420 is sandwiched between the clamping part 320 of the contact 300 and the sandwiching wall 213 of the body 200 in the connecting device S, the elastically deforming part 430 of the adapter 400 is extended or contracted in accordance with the thermal expansion deformation or the thermal contraction deformation so as to absorb such deformation. Such configuration, unlike the conventional example, can prevent the end part of the lamp part 11 and the lead terminal 12 of the cold cathode fluorescent lamp 10 from being pressed against or ripped from the adapter 400 connected to the connecting device S due to the thermal expansion deformation or the thermal contraction deformation. Consequently, it is possible to reduce the load applied to the cold cathode fluorescent lamp 10 during the thermal expansion deformation or the thermal contraction deformation.

Embodiment 3

Figure 14:
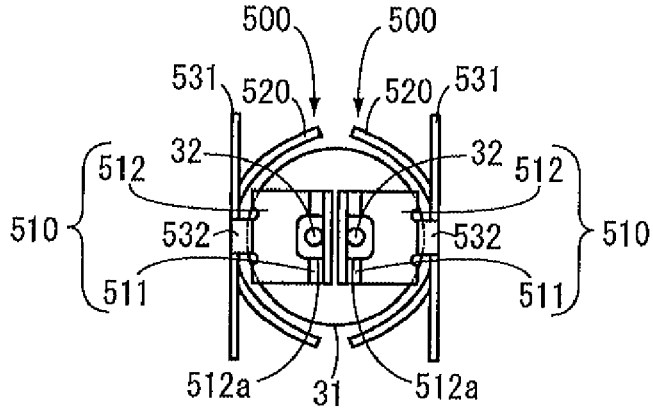
FIG. 14 illustrates a state where adapters according to a third embodiment of the present invention are connected to a hot cathode fluorescent lamp, wherein FIG. 14(*a*) is a schematic front view, FIG. 14(*b*) is a schematic plan view, and 14(*c*) is a schematic left side view.
Figure 14:
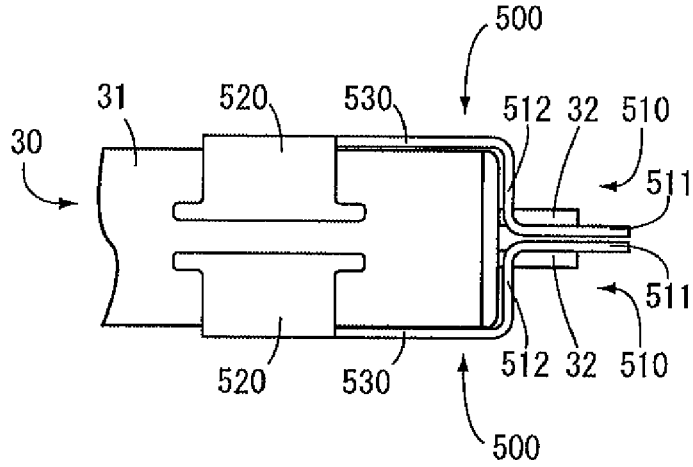
Figure 14:
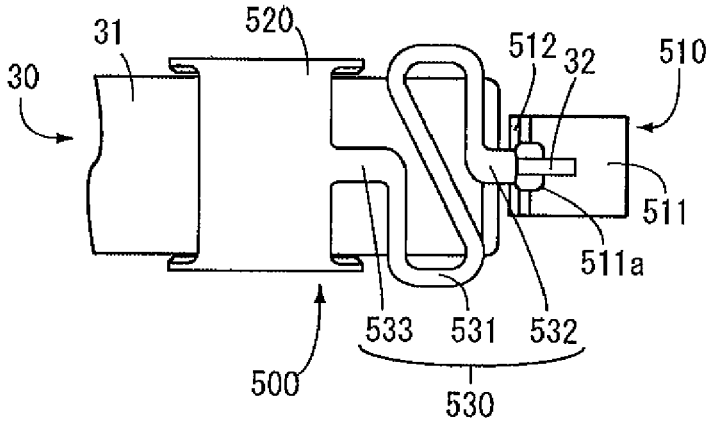
Figure 15:
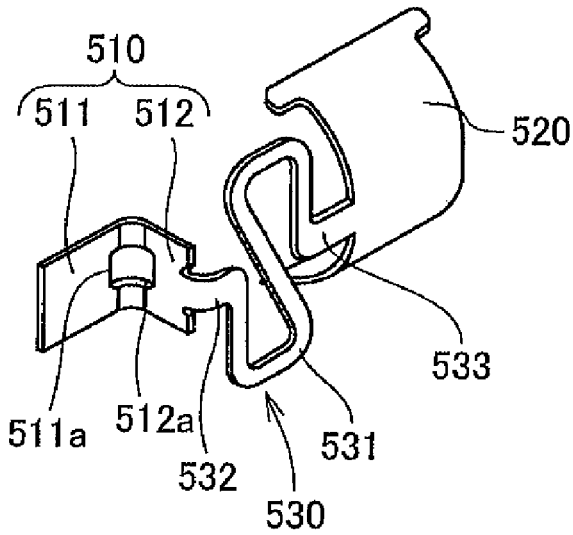
FIG. 15 illustrates one of the same adapters, wherein FIG. 15(*a*) is a perspective view seen from an upper front side, and FIG. 15(*b*) is a schematic perspective view seen from an upper back side.
Figure 15:
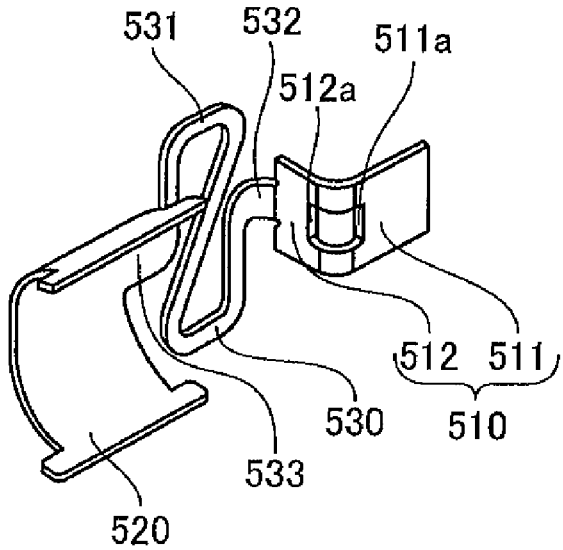

Hereinafter, adapters according to a third embodiment of the present invention are described referring to the drawings. FIG. 14 illustrates a state where the adapters according to the third embodiment of the present invention are connected to a hot cathode fluorescent lamp, wherein FIG. 14(*a*) is a schematic front view, FIG. 14(*b*) is a schematic plan view, and FIG. 14(*c*) is a schematic left side view. FIG. 15 illustrates one of the same adapters, wherein FIG. 15(*a*) is a perspective view seen from an upper front side, and FIG. 15(*b*) is a schematic perspective view seen from an upper back side.

The adapters 500 described here are connected each to one of two lead terminals 32 of a hot cathode fluorescent lamp 30. Each of the adapters 500 is a press-molded article made by press-molding a metal plate having conductivity. The adapters 500 includes a first connecting part 510 to be electrically and mechanically connected to one of the lead terminals 32 of the hot cathode fluorescent lamp 30, a second connecting part 520 having a substantially semicircular arc shape in cross-sectional view, which is spaced from the first connecting part 510 in a length direction of the hot cathode fluorescent lamp 30, and an elastically deforming part 530, which is provided between the first connecting part 510 and the second connecting part 520 and elastically deformable in accordance with thermal expansion deformation or thermal contraction deformation in the length direction of the hot cathode fluorescent lamp 30. Hereinafter, a detailed description of each part is given.

The hot cathode fluorescent lamp 30 is a well-known lamp as illustrated in FIG. 14, having a lamp part 31 and the two lead terminals 32 projected from either end surface in the length direction of the lamp part 31. Here, FIG. 14 only illustrates one end portion of the hot cathode fluorescent lamp 30.

The first connecting part 510 is a plate-like body having a substantially L shape in planar view, as illustrated in FIGS. 14 and 15. The first connecting part 510 consists of a substantially rectangular first plate 511, and a substantially rectangular second plate 512, which is arranged at a substantially right angle with respect to this first plate 511.

In a basal portion of the second plate 512, there is formed a substantially rectangular receiving hole 512*a* for receiving the lead terminal 32.

The first plate 511 is used for the connection of the lead terminal 32 received into the receiving hole 512*a* by soldering, welding or other measure. In a basal portion of the first plate 511, there is formed a rectangular hole 511*a* communicating with the receiving hole 512*a*.

The elastically deforming part 530 is made by partially notching a substantially rectangular plate body, as illustrated in FIGS. 14(*c*) and 15. The elastically deforming part 530 has a deforming body 531 that is a plate body having a substantially S shape in side view, a first coupling plate 532 having a substantially ¼ circular arc shape in cross-sectional view that couples between one end of the deforming body 531 and the second plate 512 of the first connecting part 510, and a substantially rectangular second coupling part 533 that couples between the other end of the deforming body 531 and a distal end of a top portion of the second connecting part 520. The plate body is notched at portions, leaving the deforming body 531, and the first and second coupling plates 532, 533.

The deforming body 531 is elastically deformable in a direction where the first coupling plate 532 and the second coupling plate 533 are away from each other, or in a direction where they approach each other (i.e., in the length direction of the hot cathode fluorescent lamp 30). That is, the deforming body 531 can be extended and contracted. The deforming body 531 is set to have such a spring force not to place an unduly heavy load during extension or contraction on the lead terminal 32 and a sealing part of the lamp part 31 for the lead terminal 32 in the hot cathode fluorescent lamp 30.

The adapter 500 having the above-described constitution is connected to a hot cathode fluorescent lamp 30 in the following manner. First, one of the lead terminals 32 of the hot cathode fluorescent lamp 30 is inserted into the receiving hole 512*a* of the first connecting part 510 from the rear side. Then, the lead terminal 32 is brought into abutment against the first plate 511 of the first connecting part 510. In this state, the lead terminal 32 is electrically and mechanically connected to the first plate 511 by soldering, welding or any other measure. The other lead terminal 32 of the hot cathode fluorescent lamp 30 is similarly connected to the first plate 511 of the other adapter 500 electrically and mechanically. In this manner, the two adapters 500 are connected to the two lead terminals 32 of the hot cathode fluorescent lamp 30.

Figure 16:
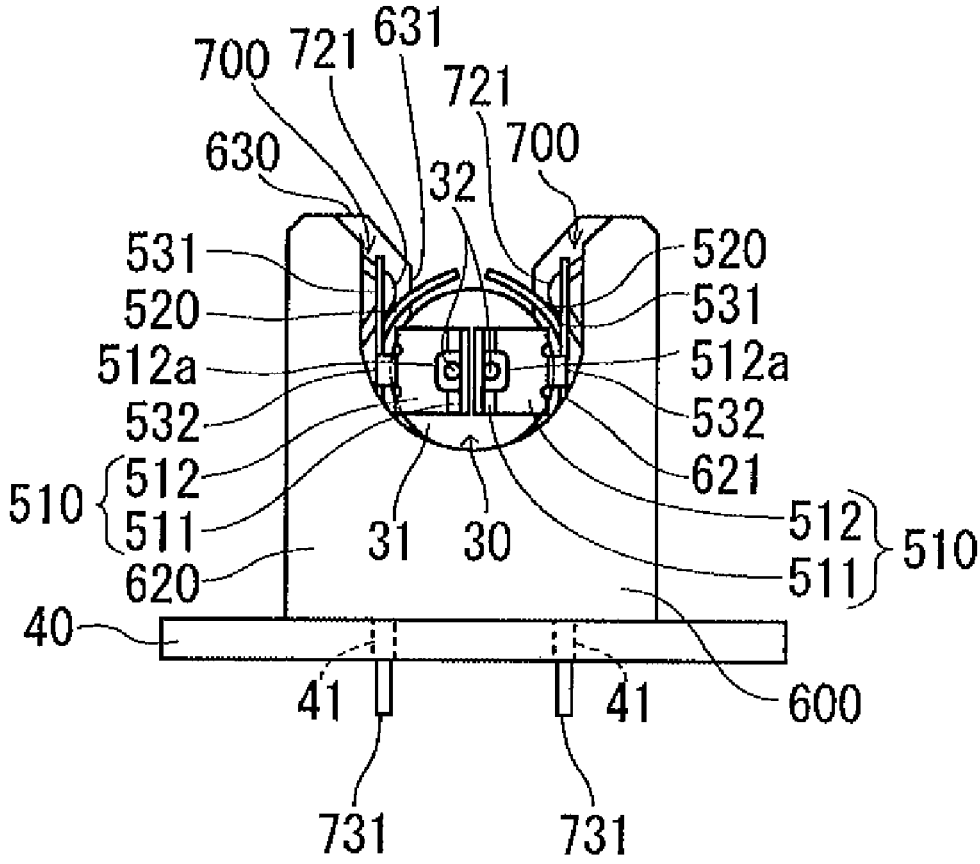
FIG. 16 is a schematic front view illustrating a state where the connecting device according to the third embodiment of the present invention is mounted on a circuit board, and has the adapters and the hot cathode fluorescent lamp connected thereto.
Figure 18:
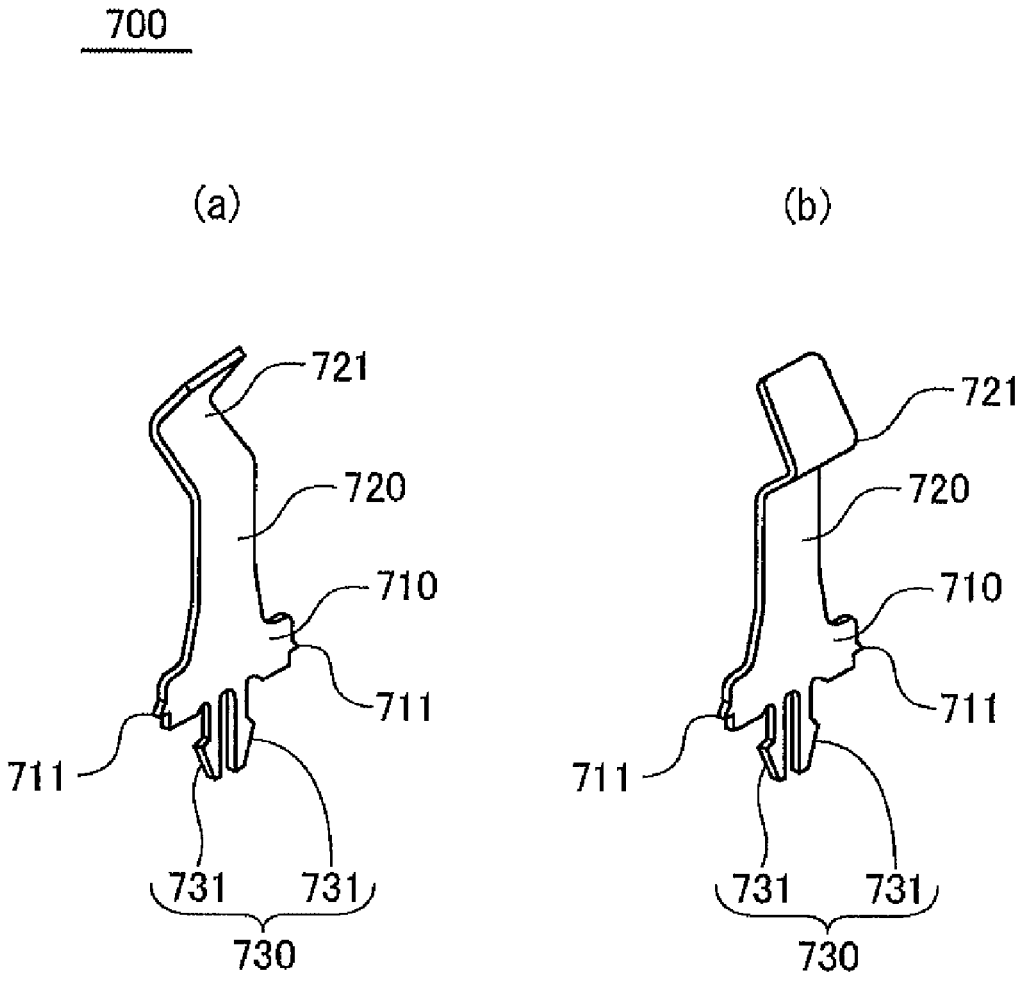
FIG. 18 illustrates a contact of the same device, wherein FIG. 18(*a*) is a schematic perspective view seen from an upper front side, and FIG. 18(*b*) is a schematic perspective view seen from an upper back side.
Figure 19:
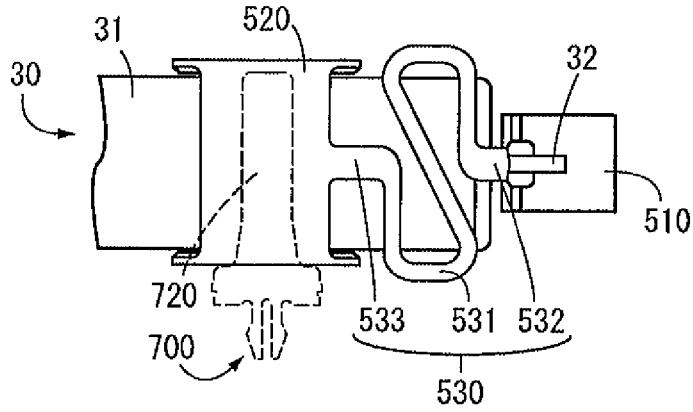
FIG. 19 is exemplary side views illustrating a state where the adapters and the hot cathode fluorescent lamp are sandwiched by the contacts of the same device, wherein FIG. 19(*a*) illustrates a state before thermal expansion or thermal contraction of the hot cathode fluorescent lamp, FIG. 19(*b*) illustrates a state where the hot cathode fluorescent lamp is thermally expanded, so that elastically deforming parts are extended, and FIG. 19(*c*) illustrates a state where the hot cathode fluorescent lamp is thermally contracted, so that the elastically deforming parts are contracted.
Figure 19:
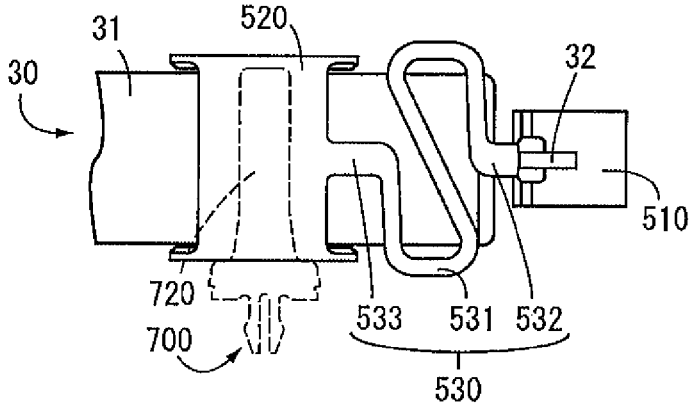
Figure 19:
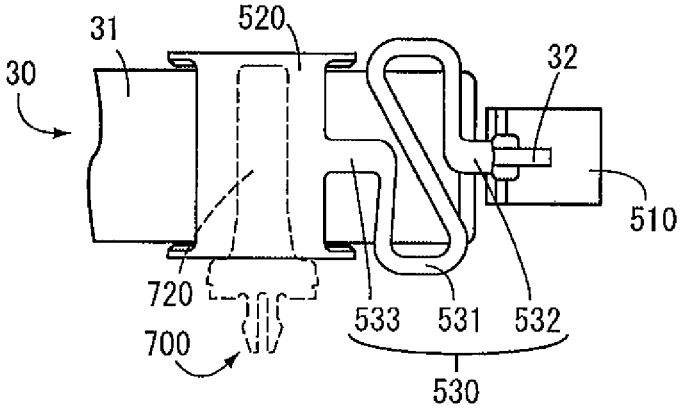

After connecting the two adapters 500 to the hot cathode fluorescent lamp 30 in the above manner, the adapters 500 are connected to a connecting device S' as described below. The connecting device S' is now described. FIG. 16 is a schematic front view illustrating a state where the connecting device according to the third embodiment of the present invention is mounted on a circuit board and has the adapters and the hot cathode fluorescent lamp connected thereto, FIG. 17 illustrates the same device, wherein FIG. 17(*a*) is a schematic front view, FIG. 17(*b*) is a schematic back view, FIG. 17(*c*) is a schematic plan view, FIG. 17(*d*) is a schematic bottom view, and FIG. 17(*e*) is a schematic side view, FIG. 18 illustrates a contact of the same device, wherein FIG. 18(*a*) is a schematic perspective view seen from an upper front side, and FIG. 18(*b*) is a schematic perspective view seen from an upper back side, and FIG. 19 is diagrammatic side views illustrating a state where the adapters and the hot cathode fluorescent lamp are sandwiched by the contacts of the same device, wherein FIG. 19(*a*) illustrates a state before thermal expansion or thermal contraction of the hot cathode fluorescent lamp, FIG. 19(*b*) illustrates a state where the hot cathode fluorescent lamp is thermally expanded and elastically deforming parts are extended, and FIG. 19(*c*) illustrates a state where the hot cathode fluorescent lamp is thermally contracted, and the elastically deforming parts are contracted.

Figure 17:
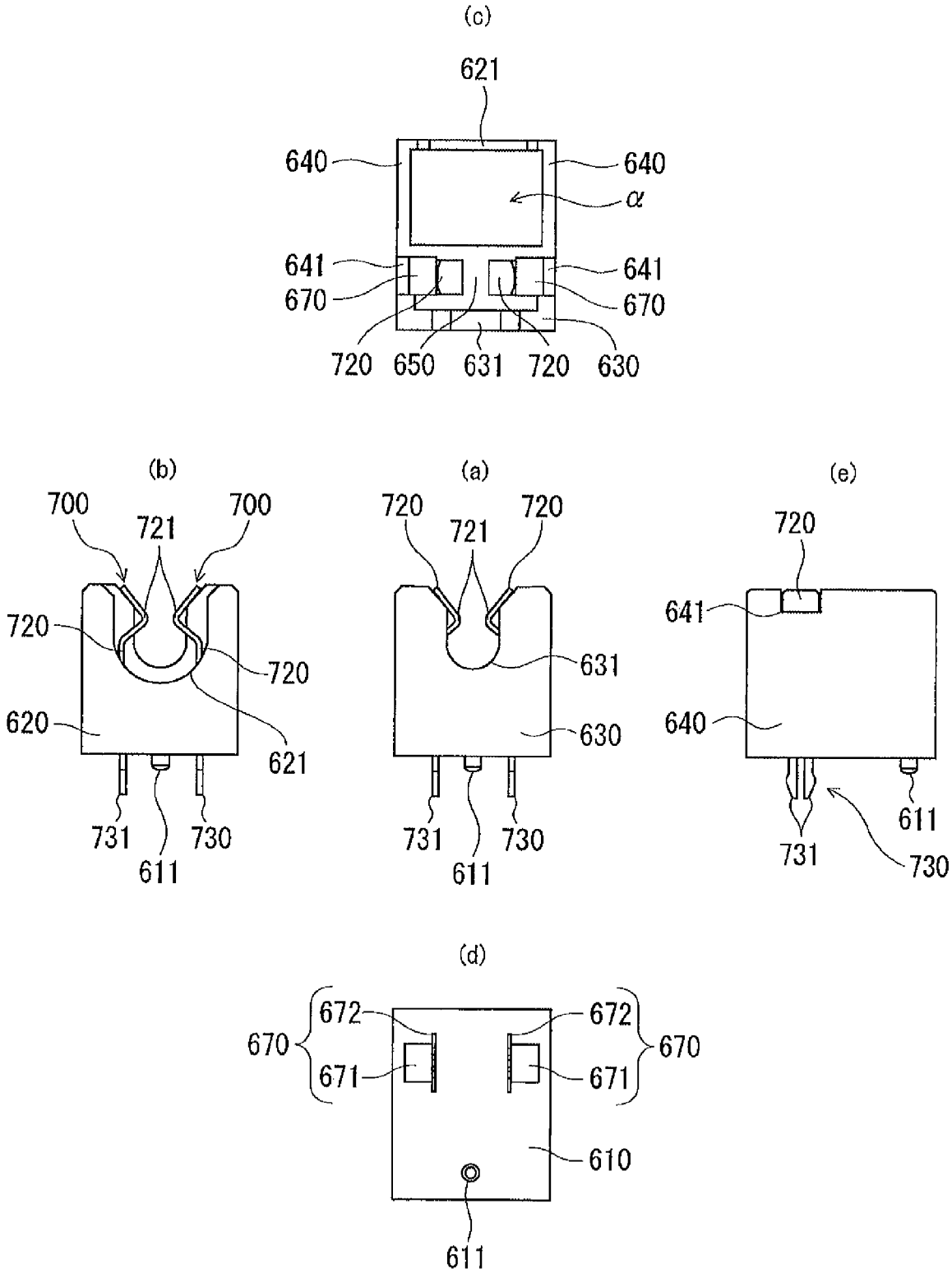
FIG. 17 illustrates the same device, wherein FIG. 17(*a*) is a schematic front view, FIG. 17(*b*) is a schematic back view, FIG. 17(*c*) is a schematic plan view, FIG. 17(*d*) is a schematic bottom view, and FIG. 17(*e*) is a schematic side view.

The connecting device S' illustrated in FIGS. 16 and 17 includes a body 600 and two contacts 700 contained in this body 600.

The body 600 is a substantially oblong box body made by injection-molding resin having insulating properties, as illustrated in FIG. 17. The body 600 has a substantially rectangular bottom plate 610, a front plate 620 provided on one lengthwise end of the bottom plate 610, a rear plate 630 provided on the other lengthwise end of the bottom plate 610, a pair of side plates 640 provided on the respective widthwise ends of the bottom plate 610, a supporting part 650 disposed in front of the rear plate 630 on the bottom plate 610, and a pair of contact containing parts 670 provided on the outsides of the supporting part 650.

A space above the bottom plate 610 defined by the front plate 620, the rear plate 630, and the pair of side plates 640 is the containing space α for containing the end part of the hot cathode fluorescent lamp 30 and the two adapters 500 connected to the lamps 30.

The front plate 620 has a substantially U-shaped recess 621, as illustrated in FIGS. 17(*b*) and 17(*c*). This recess 621 is formed to avoid interference with the hot cathode fluorescent lamp 30 contained together with the adapter 500.

The rear plate 630 is provided with a lamp containing recess 631 for containing the lamp part 31 of the hot cathode fluorescent lamp 30, as illustrated FIGS. 17(*a*) and 17C.

The supporting part 650 serves as a seat to place the two adapters 500 and the lamp part 31 of the hot cathode fluorescent lamp 30, as illustrated in FIG. 17(*c*).

As illustrated in FIGS. 17(*c*) and 17(*d*), the contact containing parts 670 each have a containing hole 671 penetrating the body 600 in a height direction and a slit 672 communicating with the containing hole 671.

Each of the slits 672 is opened into a lower surface of the bottom plate 610 and has a slightly smaller width than a width of a press-fitting plate 710 of the contact 700. More specifically, the press-fitting plate 710 of the contact 700 is press-fitted into the slit 672 from below, so that a clamping part 720 of the contact 700 is contained in the containing hole 671.

As illustrated in FIGS. 17(*c*) and 17(*e*), the side plates 640 each have a notched part 641 at its upper end and outside the contact containing part 670. The notched parts 641 are used to avoid interference with the contacts 700 when the contacts 700 contained in the contact containing parts 670 are displaced outward.

The lower surface of the bottom plate 610 has a projection 611 as illustrated in FIG. 17(*d*) to fit into the recess (not shown) of the circuit board 40.

The contacts 700 are made by press-molding a metal plate having conductivity, as illustrated in FIGS. 16 and 18. Each contact 700 has the press-fitting plate 710, the clamping part 720 extending from an upper end of the press-fitting plate 710, and a connecting part 730 extending from a lower end of the press-fitting plate 710.

At the ends of the press-fitting plate 710, there is a pair of projected locking pieces 711 projecting outward. The width of the press-fitting plate 710 including the pair of locking pieces 711 is slightly larger than the width of the slit 672 of the contact containing part 670 of the body 600. This configuration allows the press-fitting plate 710 to be press-fitted into the slit 672.

The connecting part 730 is of a substantially inverted U-shape and has a pair of locking arms 731 that can be locked into elongated locking holes 41 (see FIG. 16) of the circuit board 40. These locking arms 731 are connected to an electrode pattern of the circuit board 40 not shown.

The clamping part 720 has a bent part 721 toward its distal end, which is bent into a substantially L shape.

When the two bent parts 721 are brought into elastic contact with the second connecting parts 520 of the two adapters 500, the bent parts 721 sandwich the adapters 500 and the hot cathode fluorescent lamp 30 between supporting part 650 and themselves.

Descriptions will be made hereinafter on how to assemble the connecting device S' having the above-described constitution and how to mount the connecting device S' on the circuit board 40. First, the two contacts 700 are inserted into the respective receiving holes 671 of the pair of the contact containing parts 670 of the body 600 from below. The press-fitting plates 710 of the contacts 700 are press-fitted into the respective slits 672 of the contact containing parts 670. As a result, the clamping parts 720 of the contacts 700 are contained in the respective receiving holes 671.

After attaching the two contacts 700 are attached into the body 600 in the above manner, the projection 611 of the body 600 is fitted into the recess not shown of the circuit board 40. At the same time, the connecting parts 730 of the two contacts 700 are inserted into the associated locking holes 41 of the circuit board 40. Consequently, claws of the pairs of locking arms 731 of the connecting parts 730 are locked against respective lower surfaces of the edges of the locking holes 41 of the circuit board 40. Thereafter, the locking arms 731 are connected to the electrode pattern of the circuit board 40 by soldering or a similar measure. As a result, the connecting device S' is mounted on the circuit board 40.

Descriptions are made hereinafter on how to connect the two adapter 500, which have been connected to the hot cathode fluorescent lamp 30 as described above, to the connecting device S', which has been mounted on the circuit board 40 in the above manner. First, the end portion of the hot cathode fluorescent lamp 30 and the two adapters 500 are placed to be contained in the containing space α of the connecting device S'. At the same time, the lamp part 31 of the hot cathode fluorescent lamp 30 is placed to be contained in the lamp containing recess 631.

At this time, the second connecting parts 520 of the two adapters 500 and the lamp part 31 are inserted between the two contacts 700. Consequently, the bent parts 721 of the clamping parts 720 of the contacts 700 are pressed outward by the second connecting parts 520, so that the clamping parts 720 are elastically deformed in directions away from each other.

Once the second connecting parts 520 cross the associated bent parts 721, the clamping parts 720 are elastically deformed by their own spring force, in directions approaching each other. Due to the elastic deformation, the bent parts 721 come into elastic contact with the second connecting parts 520, so that the bent parts 721 sandwich the adapters 500 and the hot cathode fluorescent lamp 30 between the supporting part 650 and themselves. In this manner, the second connecting parts 520 of the two adapters 500 are electrically and mechanically connected to the respective clamping parts 720 of the two contacts 700.

In this state, when the hot cathode fluorescent lamp 30 is thermally expanded in the length direction thereof as illustrated in FIG. 19(*b*), the two lead terminals 32 of the hot cathode fluorescent lamp 30 and the first connecting parts 510 of the two adapters 500 move to the right in the figure. At this time, the deforming bodies 531 of the elastically deforming parts 530 of the adapters 500 are elastically deformed in directions where the first coupling parts 532 and the second coupling parts 533 are away from each other (i.e., the elastically deforming parts 530 are extended). This elastic deformation of the elastically deforming parts 530 absorbs the thermal expansion deformation of the hot cathode fluorescent lamp 30.

When the hot cathode fluorescent lamp 30 is thermally contracted in the length direction thereof, as illustrated in FIG. 19(*c*), the two lead terminals 32 of the hot cathode fluorescent lamp 30 and the first connecting parts 510 of the two adapters 500 move to the left in the figure. At this time, the deforming bodies 531 of the elastically deforming parts 530 of the two adapters 500 are elastically deformed in directions where the first coupling parts 532 and the second coupling parts 533 approach each other (i.e., the elastically deforming parts 530 are contracted). This elastic deformation of the elastically deforming parts 530 absorbs the thermal contraction deformation of the hot cathode fluorescent lamp 30.

If a need arises to remove the two adapters 500 and the hot cathode fluorescent lamp 30 from the connecting device S', the adapters 500 and the hot cathode fluorescent lamp 30 should be lifted upward. Then, the second connecting parts 520 of the two adapters 500 press the associated bent parts 721 of the two contacts 700, so that the clamping parts 720 of the contacts 700 are elastically deformed in the directions away from each other. Then, the second connecting parts 520 cross the associated bent parts 721, so that the adapters 500 can be removed from the connecting device S'.

In the above described case where the adapters 500 is used to connect the hot cathode fluorescent lamp 30 to the connecting device S' electrically and mechanically, there are the following advantages. Particularly, even if the hot cathode fluorescent lamp 30 is deformed due to thermal expansion or contraction in the state where the first connecting parts 510 of the two adapters 500 are electrically and mechanically connected to the respective two lead terminals 32 of the hot cathode fluorescent lamp 30, and where the second connecting parts 520 of the adapters 500 are sandwiched between the two contacts 700 of the connecting device S', the elastically deforming parts 530 of the adapters 500 are extended or contracted in accordance with the thermal expansion deformation or the thermal contraction deformation so as to absorb the thermal expansion deformation or the thermal contraction deformation. Such configuration, unlike the conventional example, can prevent the end portion of the lamp part 31 and the lead terminals 32 of the hot cathode fluorescent lamp 30 from being pressed against or ripped from the adapters 500 connected to the connecting device S' due to the thermal expansion deformation or the thermal contraction deformation. Consequently, it is possible to reduce the load applied to the hot cathode fluorescent lamp 30 during the thermal expansion deformation or the thermal contraction deformation.

Figure 20:
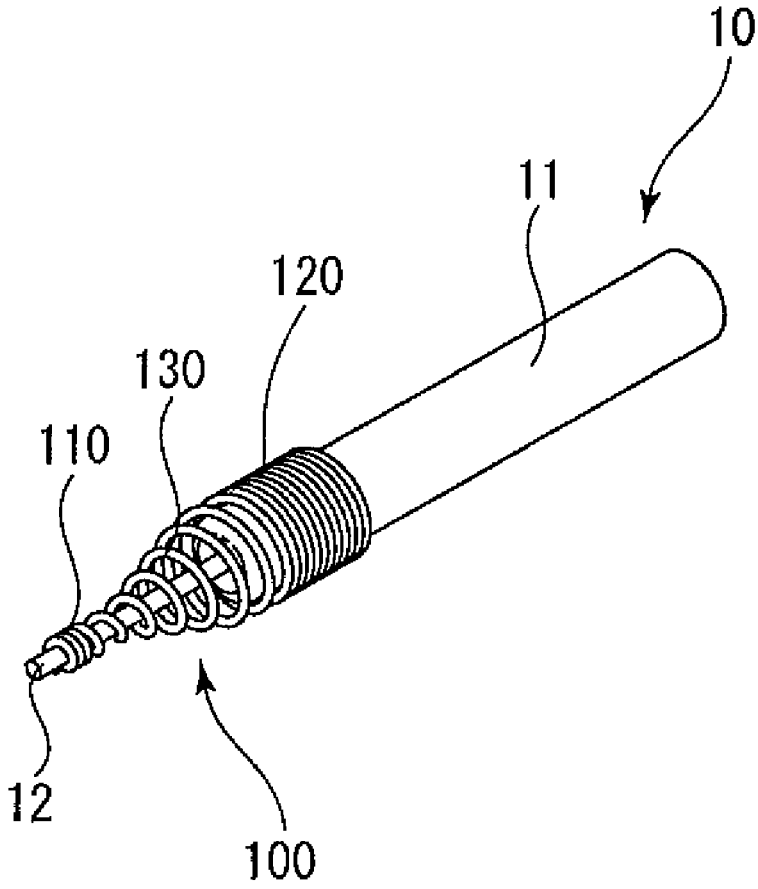
FIG. 20 is a schematic perspective view illustrating a design modification of the adapter of the first embodiment.

Of note, Each of the adapters 100, 400, 500 can be changed in design as needed, as long as it is used to connect between a lead terminal of an electronic component and a contact of a connecting device and includes a first connecting part, adapted for electrical and mechanical connection to the lead terminal; a second connecting part, disposed at a spaced relation to the first connecting part in a length direction of the electronic component and connectable to the contact electrically and mechanically; and an elastically deforming part, provided between the first and second connecting parts and elastically deformable in accordance with thermal expansion deformation or thermal contraction deformation in the length direction of the electronic component. FIG. 20 is a schematic perspective view illustrating a design modification of the adapter of the first embodiment, FIG. 21(*a*) is a schematic perspective view illustrating a design modification of the adapter of the second embodiment, and FIG. 21(*b*) is a schematic perspective view illustrating another design modification of the adapter of the second embodiment, and FIG. 22 is schematic views illustrating a design modification of the adapter of the third embodiment, wherein FIG. 22(*a*) is a side view, and FIG. 22(*b*) is a plan view.

Each of the first connecting parts 110, 410, 510 can be changed in design as needed, as long as it is adapted to be electrically and mechanically connected to the lead terminal by soldering or welding. For example, the first connecting part can be a coil body (see FIG. 20) or a circular arc body that allow insertion of a lead terminal. Any measure may be used to connect the first connecting part and the lead terminal, not limited to soldering or welding as described above.

Each of the first connecting parts 410, 510 only needs to have at least a receiving hole for receiving the lead terminal. It is optional whether or not to provide the depression 411*b*. The depression 411*b* may be provided in a first connecting part of any other shape, e.g., in the first connecting part 510.

Each of the second connecting parts 120, 420, 520 can be changed in design as needed, as long as it can be electrically and mechanically connected to a contact. For example, to receive the end part of the body part of the electronic component, besides the above-described end turn part, a second connecting part may be any tubular body whose cross section is a circle, a triangle or a polygon such as a pentagon. Alternatively, a second connecting part may be a plate-like or rod-like body to be opposed to the main body of an electronic component. In the latter case, the second connecting part may be sandwiched together with a lamp part between a contact and a body, or may be sandwiched together with a lamp part by a contact. Moreover, the second connecting part does not need to be opposed to the lamp part 11, but may be disposed in spaced relation from the first connecting part, on the opposite side of the lamp part 11.

Figure 21:
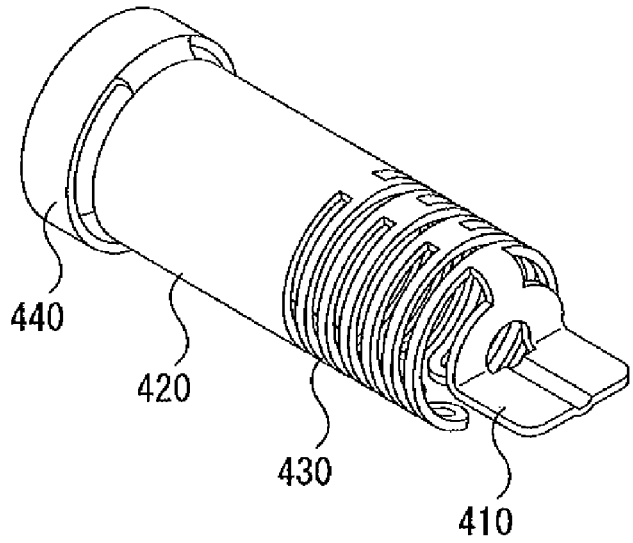
FIG. 21(*a*) is a schematic perspective view illustrating a design modification of the adapter of the second embodiment, and FIG. 21(*b*) is a schematic perspective view illustrating another design modification of the adapter of the second embodiment.
Figure 21:
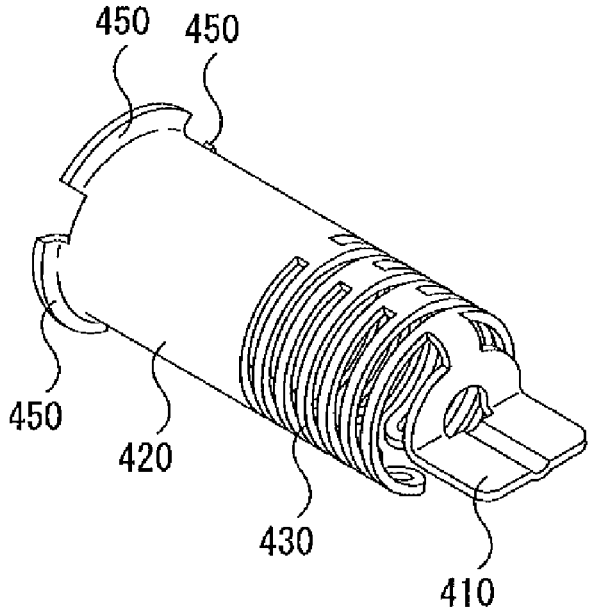
Figure 22:
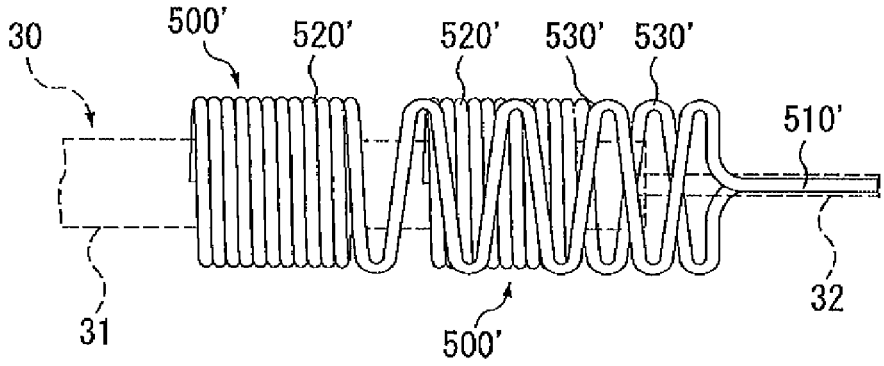
FIG. 22 is schematic views illustrating a design modification of the adapter of the third embodiment, wherein FIG. 22(*a*) is a side view, and FIG. 22(*b*) is a plan view.
Figure 22:
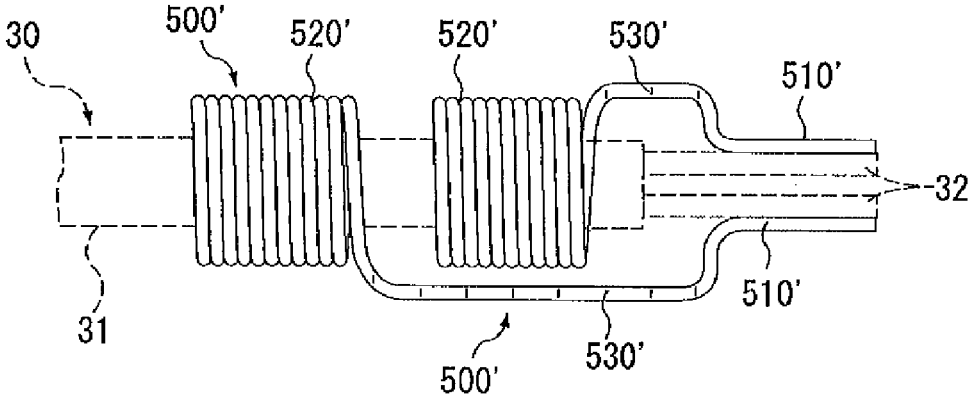

Moreover, as illustrated in FIG. 21, a rear end of the second connecting part 420 may be provided with another part such as a skirt part 440 or a flange part 450. Similarly, each of the second connecting parts 120, 520 can be also provided with the above-described another part.

Each of the elastically deforming parts 130, 430, 530 can be changed in design as needed, as long as it is interposed between the first and second connecting parts, and as long as it is elastically deformable in accordance with the thermal expansion deformation or the thermal contraction deformation in the length direction of the electronic component. For example, it can be a rubber body, or it can be a plate-like body having a substantially S shape, O shape, U shape, V shape, or a meandering curved shape (see FIG. 22) or any other shape in side view or in cross-sectional view. Moreover, in the case where the second connecting part is spaced from the first connecting part on the opposite side of the lamp part, the elastically deforming part can be a solid rubber body.

The adapters are not limited to ones made of coil springs or made by press-molding as described in the embodiments. The adapters may be made by selectively combing the first and second connecting parts and the elastically deforming parts described in the first to third embodiments. For example, the adapter 100 may have the first connecting part 410 or 510 to serve as a first connecting part. Moreover, as an adapter 500' for the hot cathode fluorescent lamp 30, a configuration as illustrated in FIG. 22 may be used—i.e., a combination of first connecting parts 510' that are rod-like bodies, second connecting parts 520' that are end turn parts, and elastically deforming parts 530' having a meandering curved shape. In this case, one of the elastically deforming parts 530' is different in length from the other elastically deforming parts 530'.

While each of the above-described adapters connects the lead terminal of the electronic component and the contact of the connecting device electrically and mechanically, each adapter may be replaced with a buffer to be interposed and only mechanically connect between a lead terminal of an electronic component and a connecting device. In this case, the buffer may include a first attachment part that is attached to the lead terminal in place of the first connecting part, and a second attachment part that can be attached to the connecting device in place of the second connecting part.

Each of the connecting devices S, S' can be changed in design as needed, as long as it has a body and connecting means. The body should be able to contain an end part of a body part and a lead terminal of an electronic component, and the adapter connected to the lead terminal. The connecting means should be contained in the body and electrically connectable to the adapter.

In the case where the buffer is used in place of the adapter, the above connecting device needs to further include holding means for mechanically holding the buffer. In this case, it is favorable that the connecting device be electrically connected directly to the lead terminal of the electronic component.

The sandwiching wall 213 can be changed in design as needed, as long as it has a shape adapted to sandwich the second connecting part of the adapter between the clamping part of the contact and itself. Therefore, it is optional whether or not to provide the irregular surface 213*a* in the sandwiching wall 213.

While it is described above that the sandwiching wall 213 has the irregular surface 213*a* as a stopper, the stopper may be modified into any structure that restrains the second connecting part from moving in the length direction of the electronic component in accordance with the thermal expansion deformation or thermal contraction deformation of the electronic component. For example, the stopper may be a pair of projections that is abuttable against ends of the second connecting part, or may be a recess to fit the second connecting part.

The locking claws 230 can be changed in design as needed, as long as they are each a substantially L-shaped member having a distal part whose thickness is slightly smaller than the width of the wide part 21*a* of the locking hole 21 of the circuit board 20, and a basal part that is substantially perpendicular to this distal part and whose thickness is slightly smaller than the width of the narrow part 21*b* of the locking hole 21. There should be at least one locking claw in a body of a connecting device.

The arms 240 can be arbitrarily changed in design as long as they are each an elongated member oriented in the width direction of the locking claw 230, and as long as its distal part can swing along the surface of the circuit board. Moreover, the arms 240 may be offset from the locking claws 230 in the width direction of the body 200. For example, the arms 240 can be provided on an end of the second box body 220. In this case, the lock holes 22 of the circuit board 20 can be provided in corresponding positions to the arms. Thus, the locking holes 21 and the lock holes 22 do not need to be communicated with each other. There should be at least one arm in a body of a connecting device.

The locking projections 250 described above as columnar may be changed in design as needed, as long as they are adapted to be inserted into the lock holes 22. The body 600 can be also provided with the arms 240 and the locking projections 250 to be mounted on the circuit board 20.

Each of the contacts 300, 700 can be changed in design as needed, as long as it can be connected to the second connecting part of the adapter electrically and mechanically, and as long as it is contactable with the contact pattern of the circuit board.

The shape of the clamping part 320 can be changed in design, as long as it can sandwich the second connecting part. Moreover, although it is described above that the second connecting part 120 is sandwiched between the clamping part 320 and the sandwiching wall 213, it is not limited to this. For example, the second connecting part may be sandwiched by a pair of clamping parts.

Moreover, the above-described stopper can be provided in an inner surface of the clamping part. The stopper provided in the clamping part can bring about a similar effect to that of the irregular surface 213*a*, by abutting against the second connecting part of the adapter. The stopper can alternatively be provided on an outer surface of the second connecting part of the adapter. A similar stopper can be provided on the clamping part 720 of the contact 700.

The shape of the holding part 330 can be changed as needed, as long as it can sandwich the body part of the electric component. Moreover, although it is described above that the holding part 330 sandwiches the body part between the edge part of the opening 211 of the body 200 and itself, it is not limited to this. For example, a pair of holding parts may sandwich the body part. The contacts 700 can be each provided with the holding part.

The contact part 340 only needs to be electrically connectable to the circuit board 20. For example, the contact part 340 may be a plate-like body that can be inserted into through holes of the circuit board 20, can be a hook-like body that can contact the contact pattern of the circuit board to be surface mounted, or may have a shape allowing pressing attachment of a lead line for connecting to a circuit pattern of the circuit board or any other electronic component. Alternatively, the contact part 340 may be designed as a separate member to be brought into contact with the base plate 310.

It should be noted that the present invention is not limited to connection to the cold cathode fluorescent lamp 10 or the hot cathode fluorescent lamp 30 as described in the above embodiments. Instead, the invention can be obviously applied to any other electronic component such as a hot cathode fluorescent lamp that has a body part and at least one lead terminal provided in the body part and that is capable of thermal expansion deformation or thermal contraction deformation. If an electronic component has three or more lead terminals, the three or more adapters and contacts as described above may be used.

What is claimed is:

1. An adapter for providing connection between a lead terminal of an electronic component and a contact of a connecting device, the electronic component including a main body and the lead terminal extending from an end part of the main body, the adapter being a coil spring comprising:

a first connecting part being a rod-like part or a tightly coiled part of tubular shape provided at an end of the coil spring, the first connecting part being adapted for electrical and mechanical connection to the lead terminal;

a second connecting part being a coiled part of tubular shape provided at the other end of the coil spring, the second connecting part having such an inner diameter as to receive the end part of the main body of the electronic component with a slight clearance therebetween and being connectable to the contact electrically and mechanically; and an elastically deforming part being a loosely coiled part provided between the first and second connecting parts, the elastically deforming part having such an inner diameter as to receive at least one of the main body and the lead terminal and being elastically deformable in accordance with thermal expansion deformation or thermal contraction deformation in a length direction of the electronic component.

2. An adapter for providing connection between a lead terminal of an electronic component and a contact of a connecting device, the electronic component including a main body and a lead terminal, the lead terminal extending from an end part of the main body, the adapter comprising:

a first connecting part, adapted for electrical and mechanical connection to the lead terminal;

a second connecting part, disposed at a spaced relation to the first connecting part in a length direction of the electronic component and connectable to the contact electrically and mechanically; and an elastically deforming part, provided between the first and second connecting parts and elastically deformable in accordance with thermal expansion deformation or thermal contraction deformation in the length direction of the electronic component, wherein the second connecting part is of a tubular shape to receive the end part of the main body of the electronic component and is adapted to be sandwiched by the contact of the connecting device.

3. An adapter for providing connection between a lead terminal of an electronic component and a contact of a connecting device, the electronic component including a main body and a lead terminal, the lead terminal extending from an end part of the main body, the adapter comprising:

a first connecting part, adapted for electrical and mechanical connection to the lead terminal;

a second connecting part, disposed at a spaced relation to the first connecting part in a length direction of the electronic component and connectable to the contact electrically and mechanically; and an elastically deforming part, provided between the first and second connecting parts and elastically deformable in accordance with thermal expansion deformation or thermal contraction deformation in the length direction of the electronic component, wherein the second connecting part is arranged so as to be opposed to the end part of the main body of the electronic component in a state where the first connecting part is connected to the lead terminal, and the second connecting part is adapted to be sandwiched together with the main body between the contact of the connecting device and a body of the connecting device.

4. An adapter for providing connection between a lead terminal of an electronic component and a contact of a connecting device, the electronic component including a main body and a lead terminal, the lead terminal extending from an end part of the main body, the adapter comprising:

a first connecting part, adapted for electrical and mechanical connection to the lead terminal;

a second connecting part, disposed at a spaced relation to the first connecting part in a length direction of the electronic component and connectable to the contact electrically and mechanically; and an elastically deforming part, provided between the first and second connecting parts and elastically deformable in accordance with thermal expansion deformation or thermal contraction deformation in the length direction of the electronic component, wherein the second connecting part is arranged so as to be opposed to the end part of the main body of the electronic component in a state where the first connecting part is connected to the lead terminal, and the second connecting part is adapted to be sandwiched together with the main body by the contact of the connecting device.

5. An adapter for providing connection between a lead terminal of an electronic component and a contact of a connecting device, the electronic component including a main body and the lead terminal extending from an end part of the main body, the adapter comprising:

a first connecting part, adapted for electrical and mechanical connection to the lead terminal;

a second connecting part being a tubular plate having such an inner diameter as to receive the end part of the main body of the electronic component with a slight clearance therebetween and being connectable to the contact electrically and mechanically; and an elastically deforming part being a tubular plate that is partially notched, provided between the first and second connecting parts and elastically deformable in accordance with thermal expansion deformation or thermal contraction deformation in the length direction of the electronic component, wherein the elastically deforming part includes:

a base plate of generally rectangular shape continuing to the second connecting part, a plurality of coupling plates arranged in spaced relation between the base plate and the first connecting part, and a plurality of deforming parts disposed between the base plate and a first one of the coupling plates, between the first one and a second one of the coupling plates, and between the second one of the coupling plates and the first connecting part, the deforming parts each have a pair of curved parts of substantially U shape in side view, each pair of the curved parts being arranged symmetrically along a direction perpendicular to said length direction such that top parts of the curved parts are opposed to each other.

6. An adapter for providing connection between a lead terminal of an electronic component and a contact of a connecting device, the electronic component including a main body and the lead terminal extending from an end part of the main body, the adapter comprising:

a first connecting part, adapted for electrical and mechanical connection to the lead terminal;

a second connecting part being a plate of substantially semicircular arc shape in cross-sectional view, being adapted to the main body of the electronic component, and being connectable to the contact electrically and mechanically; and an elastically deforming part, provided between the first and second connecting parts and elastically deformable in accordance with thermal expansion deformation or thermal contraction deformation in the length direction of the electronic component, wherein the elastically deforming part includes:

a deforming body being a plate body having a substantially S shape in side view, a first coupling plate adapted to couple between one end of the deforming body and the first connecting part, and a second coupling part adapted to couple between the other end of the deforming body and the second connecting part.

7. The adapter according to claim 1, wherein the second connecting part is more closely coiled than the elastically deforming part.

8. The adapter according to any one of claims 2, 3 and 4, wherein the elastically deforming part is a partially notched plate-like body.

9. The adapter according to any one of claims 2, 3 and 4, wherein the first connecting part is provided with a receiving hole to receive the lead terminal.

10. The adapter according to claim 9, wherein the first connecting part is a plate-like body of a substantially L shape in cross-sectional view, bent at a substantially right angle to form a first plate and a second plate, the receiving hole is provided in a portion of the second plate on the first plate side, and the first plate is provided with a depression that communicates with the receiving hole, the depression being adapted to fit the lead terminal received in the receiving hole.

11. A connecting device adapted for connection to the adapter according to claim 2 or claim 4, the connecting device comprising:

a body, including a containing part adapted to contain the adapter, an end part of a body part of an electronic component, and a lead terminal of the electronic component; and a contact, including a clamping part to be contained in the containing part of the body, the clamping part being adapted to sandwich the second connecting part of the adapter.

12. The connecting device according to claim 11, wherein the contact further has a pair of holding parts, the holding parts being adapted to sandwich the body part of the electronic component.

13. The connecting device according to claim 11, wherein an inner surface of the clamping part of the contact is provided with a stopper for preventing the second connecting part from moving in the length direction of the electronic component in accordance with thermal expansion deformation or thermal contraction deformation of the electronic component.

14. The connecting device according to claim 13, wherein the stopper comprises an irregular surface that is abuttable against the second connecting part.

15. The connecting device according to claim 11, wherein the connecting device is mountable on a circuit board having an elongated locking hole, the body further includes a substantially L-shaped locking claw, the locking claw having a basal part and a distal part substantially perpendicular to the basal part and being receivable in the locking hole, the locking hole has a wide part having a width slightly larger than a thickness of the distal part of the locking claw, and a narrow part having a width slightly larger than a thickness of the basal part of the locking claw, and upon insertion of the locking claw into the wide part and movement of the inserted locking claw to the narrow part, the distal part of the locking claw is locked in an edge part of the narrow part.

16. The connecting device according to claim 15, wherein a contact pattern is provided on the circuit board, and the contact further includes a contact part that is contactable with the contact pattern in a state where the locking claw is locked in the narrow part of the locking hole.

17. The connecting device according to claim 15, wherein the circuit board further includes a lock hole, the body further includes:

an arm, being oriented along a width of the locking claw, a distal part of the arm being swingable along a surface of the circuit board, and a locking projection, being provided in the distal part of the arm and receivable in the lock hole, the lock hole has:

a mountain part, being provided in one side surface and inclined upward in a direction from the wide part to the narrow part, a foot area, being provided at the foot of the mountain part, and a valley area, being provided beyond the mountain part, and upon insertion of the locking claw into the wide part and insertion of the locking projection into the foot area, in accordance with said movement of the locking claw, the locking projection moves across the mountain part while swinging the distal part of the arm, and the locking projection falls to the valley area to be locked against the mountain part.

18. The connecting device according to claim 17, wherein a contact pattern is provided on the circuit board, and the contact further includes a contact part that is contactable with the contact pattern in a state where the locking claw is locked in the narrow part of the locking hole.

19. The adapter according to any one of claims 1, 5 and 6, wherein the second connecting part and is adapted to be sandwiched between the contact of the connecting device and a body of the connecting device.

20. A connecting device adapted for connection to the adapter according to claim 19, the connecting device comprising:

a body, including a containing part adapted to contain the adapter, an end part of a body part of an electronic component, and a lead terminal of the electronic component; and a contact, including a clamping part to be contained in the containing part of the body, the clamping part being adapted to sandwich the second connecting part of the adapter between an inner wall surface of the containing part and itself.

21. The connecting device according to claim 20, wherein the contact further has a holding part, the holding part being adapted to hold the body part of the electronic component between a wall surface of the body and itself.

22. The connecting device according to claim 20, wherein the inner wall surface of the containing part is provided with a stopper for preventing the second connecting part from moving in the length direction of the electronic component in accordance with thermal expansion deformation or thermal contraction deformation of the electronic component.

23. The connecting device according to claim 22, wherein the stopper comprises an irregular surface that is abuttable against the second connecting part.

24. The connecting device according to claim 20, wherein an inner surface of the clamping part of the contact is provided with a stopper for preventing the second connecting part from moving in the length direction of the electronic component in accordance with thermal expansion deformation or thermal contraction deformation of the electronic component.

25. The connecting device according to claim 24, wherein the stopper comprises an irregular surface that is abuttable against the second connecting part.

26. The connecting device according to claim 20, wherein the connecting device is mountable on a circuit board having an elongated locking hole, the body further includes a substantially L-shaped locking claw, the locking claw having a basal part and a distal part substantially perpendicular to the basal part and being receivable in the locking hole, the locking hole has a wide part having a width slightly larger than a thickness of the distal part of the locking claw, and a narrow part having a width slightly larger than a thickness of the basal part of the locking claw, and upon insertion of the locking claw into the wide part and movement of the inserted locking claw to the narrow part, the distal part of the locking claw is locked in an edge part of the narrow part.

27. The connecting device according to claim 26, wherein a contact pattern is provided on the circuit board, and the contact further includes a contact part that is contactable with the contact pattern in a state where the locking claw is locked in the narrow part of the locking hole.

28. The connecting device according to claim 26, wherein the circuit board further includes a lock hole, the body further includes:

an arm, being oriented along a width of the locking claw, a distal part of the arm being swingable along a surface of the circuit board, and a locking projection, being provided in the distal part of the arm and receivable in the lock hole, the lock hole has:

a mountain part, being provided in one side surface and inclined upward in a direction from the wide part to the narrow part, a foot area, being provided at the foot of the mountain part, and a valley area, being provided beyond the mountain part, and upon insertion of the locking claw into the wide part and insertion of the locking projection into the foot area, in accordance with said movement of the locking claw, the locking projection moves across the mountain part while swinging the distal part of the arm, and the locking projection falls to the valley area to be locked against the mountain part.

29. The connecting device according to claim 28, wherein a contact pattern is provided on the circuit board, and the contact further includes a contact part that is contactable with the contact pattern in a state where the locking claw is locked in the narrow part of the locking hole.

* * * * *